US010233007B2

(12) United States Patent
Secchi et al.

(10) Patent No.: US 10,233,007 B2
(45) Date of Patent: Mar. 19, 2019

(54) PACKAGE, PACKAGED PRODUCT, METHOD OF RELEASING AT LEAST ONE AGENT INTO CHAMBER PORTION OF PACKAGE, AND PROCESS OF PACKAGING

(71) Applicant: CRYOVAC, INC., Charlotte, NC (US)

(72) Inventors: Alessandra Secchi, Milan (IT); Riccardo Palumbo, Arona (IT); Dario Distefano, Scordia (IT); Serena Della Bianca, Rho (IT)

(73) Assignee: Cryovac, LLC, Charlotte, NC (US)

( * ) Notice: Subject to any disclaimer, the term of this patent is extended or adjusted under 35 U.S.C. 154(b) by 0 days.

(21) Appl. No.: 15/570,391

(22) PCT Filed: Apr. 27, 2016

(86) PCT No.: PCT/EP2016/059444
§ 371 (c)(1),
(2) Date: Oct. 30, 2017

(87) PCT Pub. No.: WO2016/174111
PCT Pub. Date: Nov. 3, 2016

(65) Prior Publication Data

US 2018/0141737 A1 May 24, 2018

Related U.S. Application Data

(60) Provisional application No. 62/154,796, filed on Apr. 30, 2015.

(51) Int. Cl.
*B65D 25/08* (2006.01)
*B65D 81/20* (2006.01)
(Continued)

(52) U.S. Cl.
CPC ..... *B65D 81/2084* (2013.01); *B65B 29/10* (2013.01); *B65B 31/021* (2013.01);
(Continued)

(58) Field of Classification Search
CPC ..... B65D 81/2084; B65D 81/2023; B65D 81/3266; B65B 29/10; B65B 31/021; B65B 31/028; B65B 25/001; B65B 2230/02
(Continued)

(56) References Cited

U.S. PATENT DOCUMENTS 2,874,830 A * 2/1959 Birmingham, Jr. ..... B65D 81/3266 206/221
3,539,794 A * 11/1970 Kennerly ..... C09K 11/07 206/219
(Continued)

FOREIGN PATENT DOCUMENTS

CN 101453977 A 6/2009

OTHER PUBLICATIONS

Written Opinion of the International Searching Authority in PCT/EP2016/059444, dated Nov. 3, 2016.

*Primary Examiner* — Luan K Bui
(74) *Attorney, Agent, or Firm* — Jon M. Isaacson

(57) ABSTRACT

A package includes a chamber portion, a hollow frame adjacent to the chamber portion, and a frangible chamber closure zone between the chamber portion and the frame. A method of releasing at least one agent into a chamber portion of a package includes rupturing a frangible closure between the chamber portion and a hollow frame to release the at least one agent contained in the hollow frame into the chamber portion. A process of packaging includes providing a base web; placing a product on the base web; positioning over the product a lid web; fixing the lid web to the base web to form a chamber portion enclosing the product; fixing the lid web to the base web to form a hollow frame adjacent to the chamber portion; and including an agent in the frame.

29 Claims, 21 Drawing Sheets

(51) Int. Cl.

| | |
|---|---|
| ***B65B 29/10*** | (2006.01) |
| ***B65B 31/02*** | (2006.01) |
| ***B65D 81/32*** | (2006.01) |
| *B65B 25/00* | (2006.01) |

(52) U.S. Cl.
CPC ..... *B65B 31/028* (2013.01); *B65D 81/3266* (2013.01); *B65B 25/001* (2013.01); *B65B 2230/02* (2013.01); *B65D 81/2023* (2013.01)

(58) Field of Classification Search
USPC ..... 206/219–222, 210, 213.1, 568
See application file for complete search history.

(56) References Cited

U.S. PATENT DOCUMENTS

| | | | | |
|---|---|---|---|---|
| 4,805,767 | A | 2/1989 | Newman | |
| 5,616,337 | A * | 4/1997 | Kasianovitz | B65D 81/3266 206/219 |
| 5,984,089 | A * | 11/1999 | Dotson | B65D 75/5805 15/104.93 |
| 7,086,528 | B2 * | 8/2006 | Raia | B65D 75/327 206/209 |
| 2003/0102229 | A1 * | 6/2003 | Inuzuka | B65D 75/5855 206/219 |
| 2005/0126941 | A1 | 6/2005 | Ferri et al. | |
| 2007/0125667 | A1 * | 6/2007 | Lee | B65D 75/5805 206/219 |
| 2009/0320411 | A1 | 12/2009 | Carvallo | |
| 2010/0140119 | A1 * | 6/2010 | Katsuki | B65D 81/3266 206/219 |
| 2011/0100844 | A1 * | 5/2011 | Cimaglio | B65D 81/3266 206/219 |
| 2013/0153448 | A1 * | 6/2013 | Yoshikawa | A61J 1/10 206/219 |

* cited by examiner

FIG.1
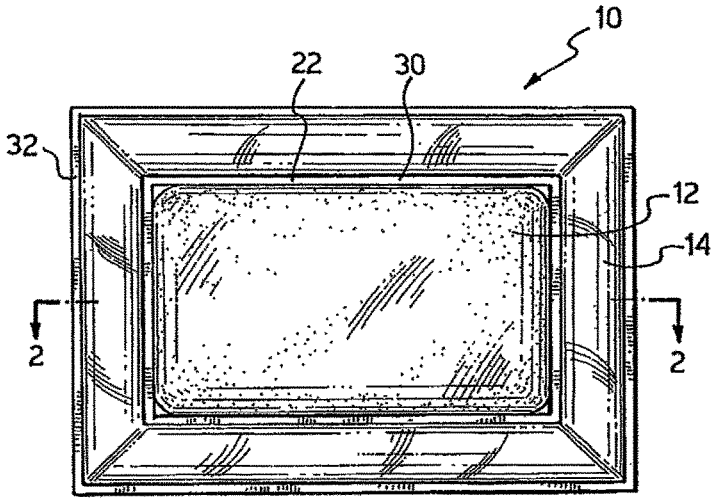
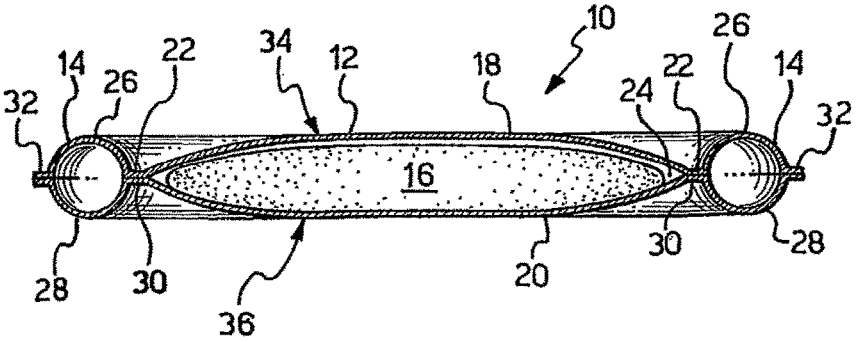
FIG.2

FIG.3
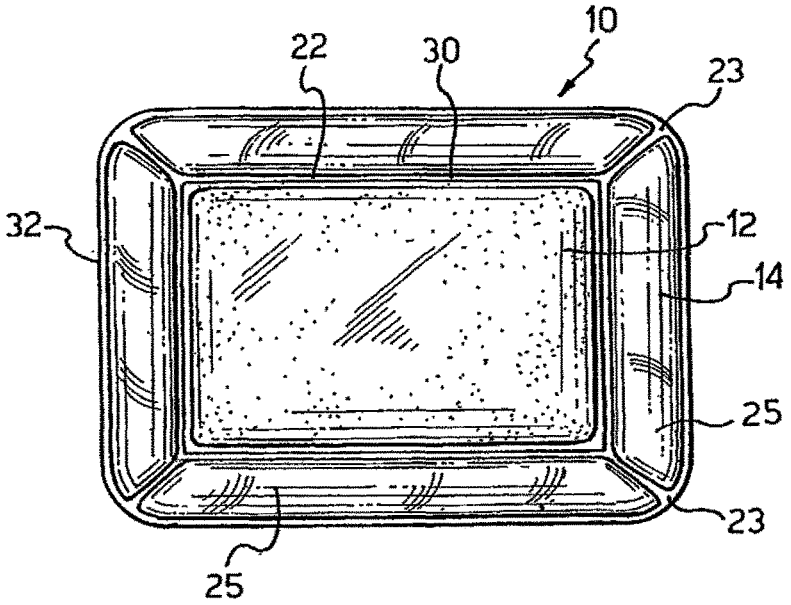
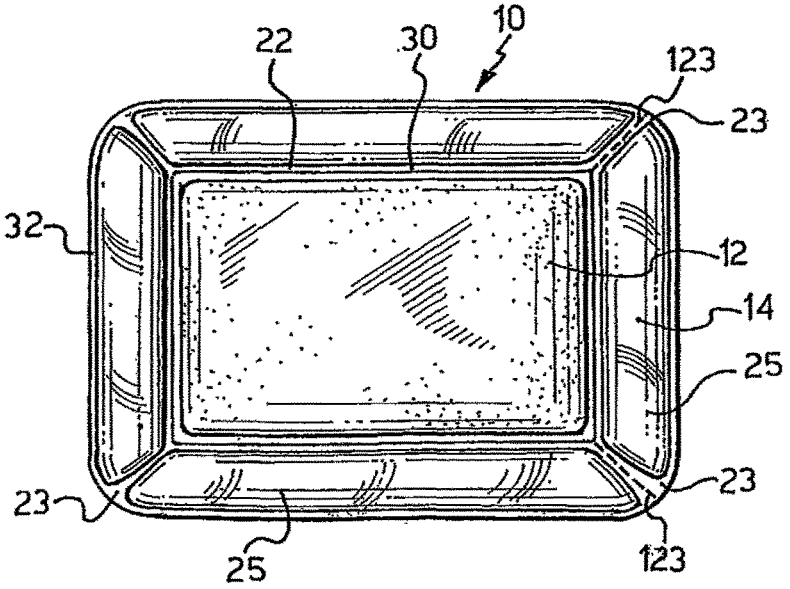
FIG.4

FIG.5
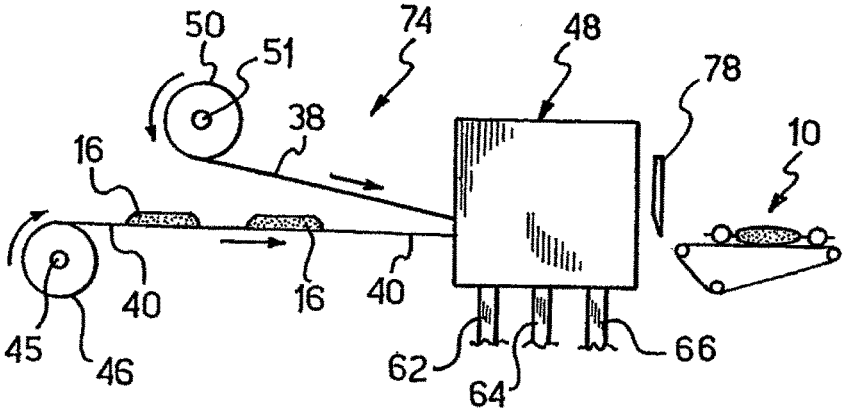
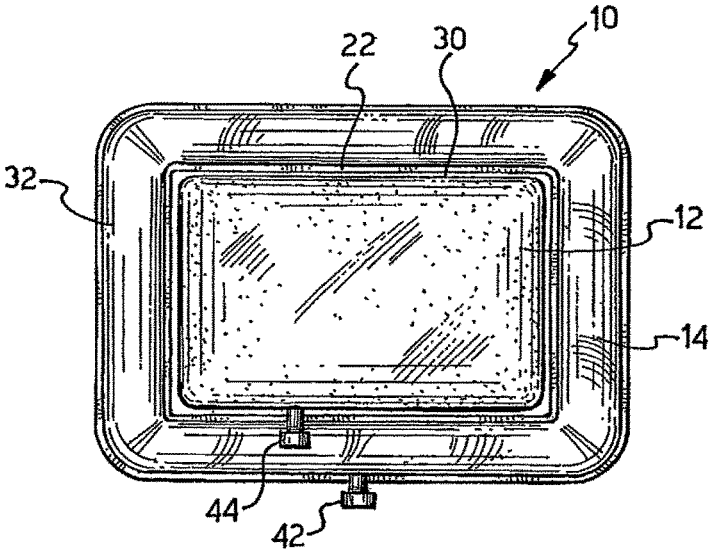
FIG.6

FIG.7
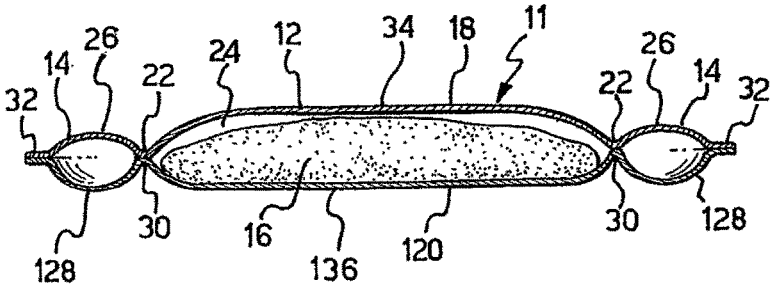
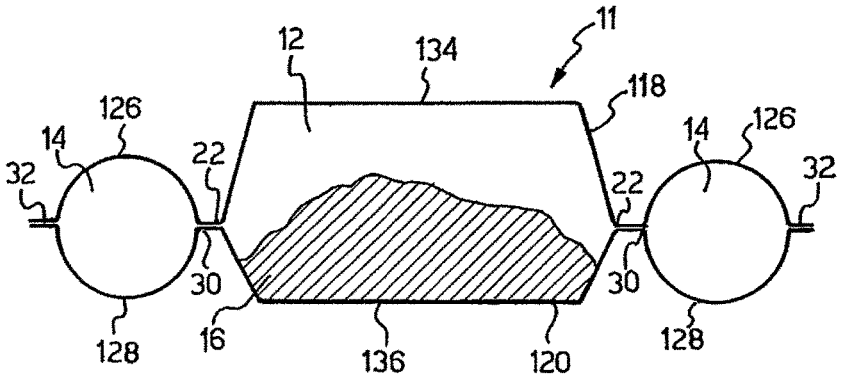
FIG.8

FIG.18
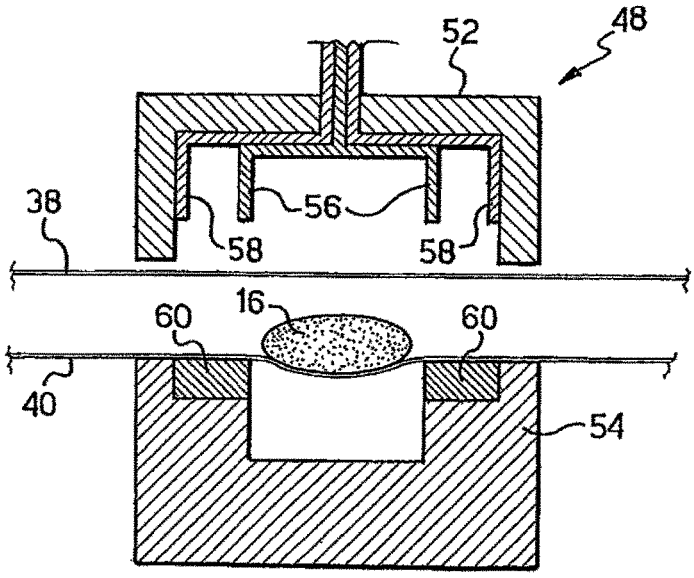
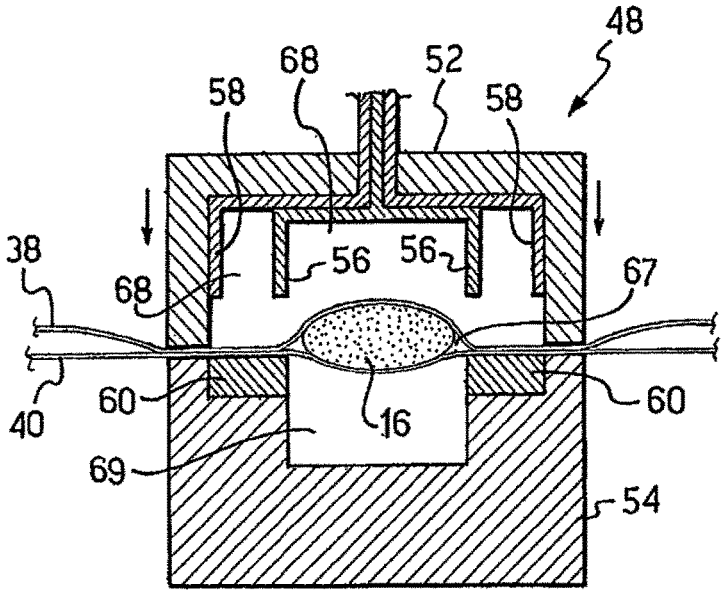
FIG.19

FIG.20
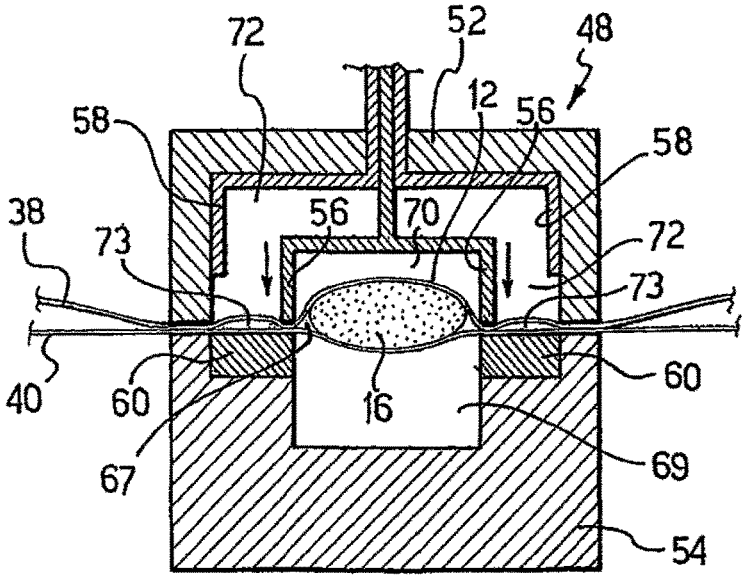
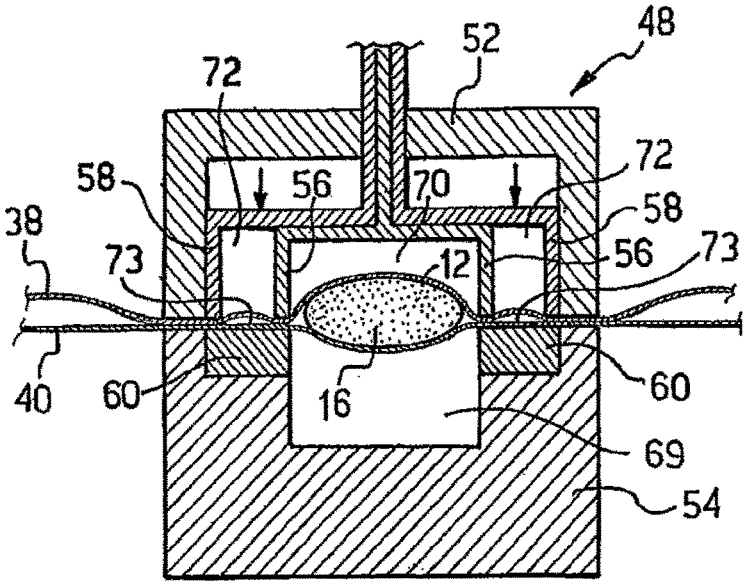
FIG.21

FIG.22
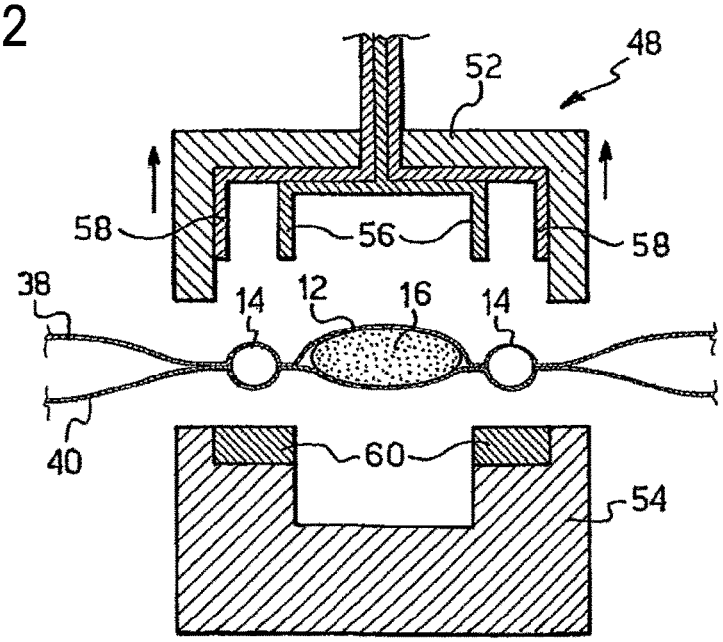
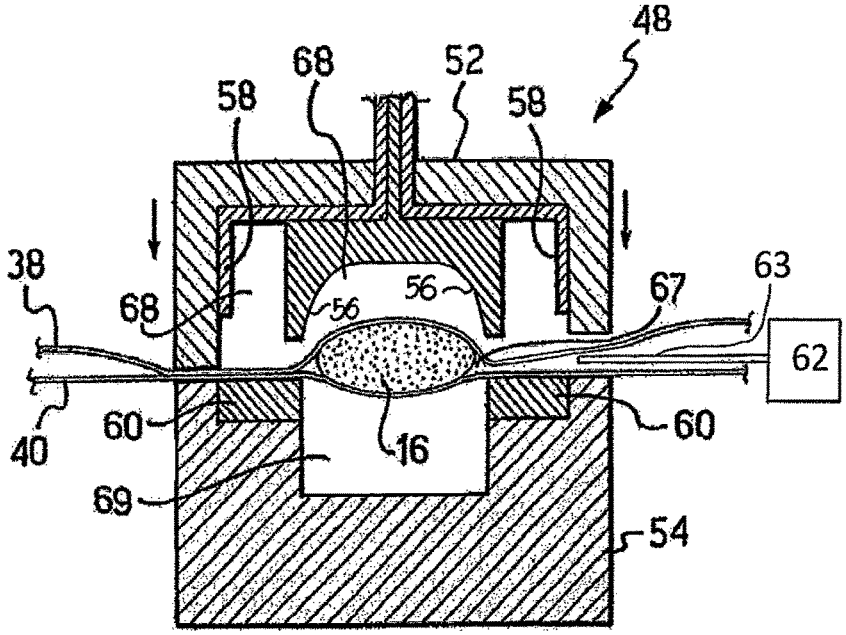
FIG.23

FIG.24
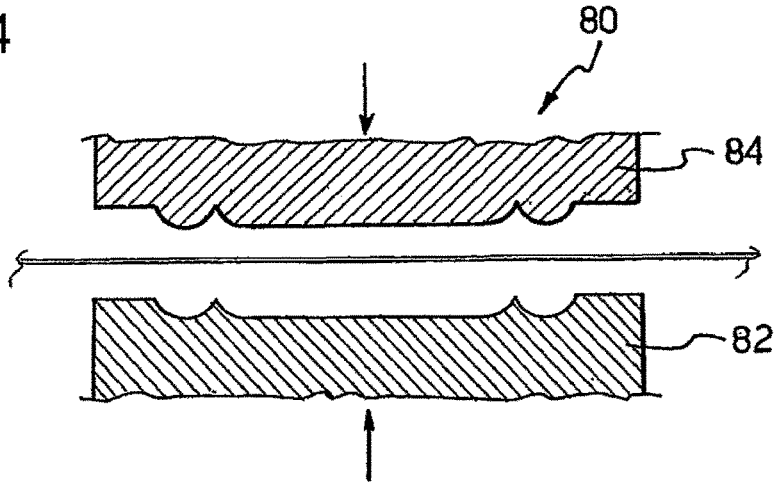
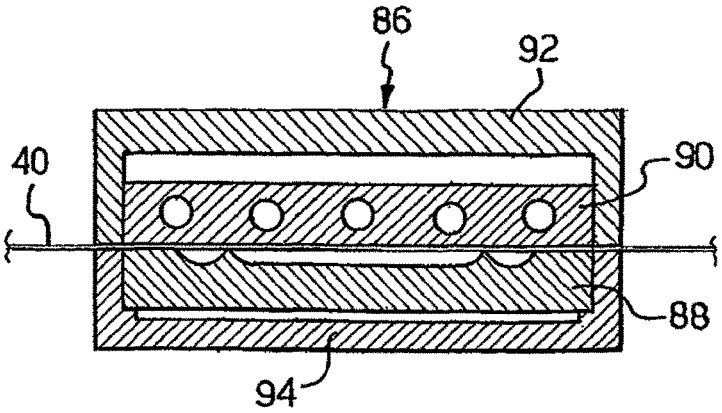
FIG.25

FIG.27
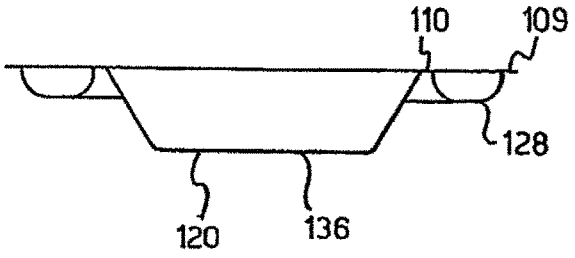
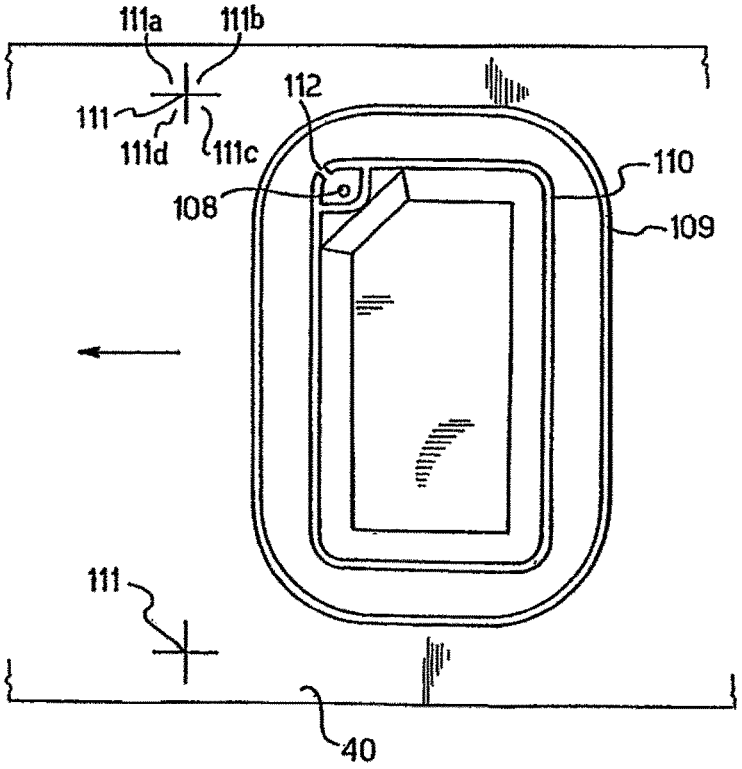
FIG.28

FIG.29
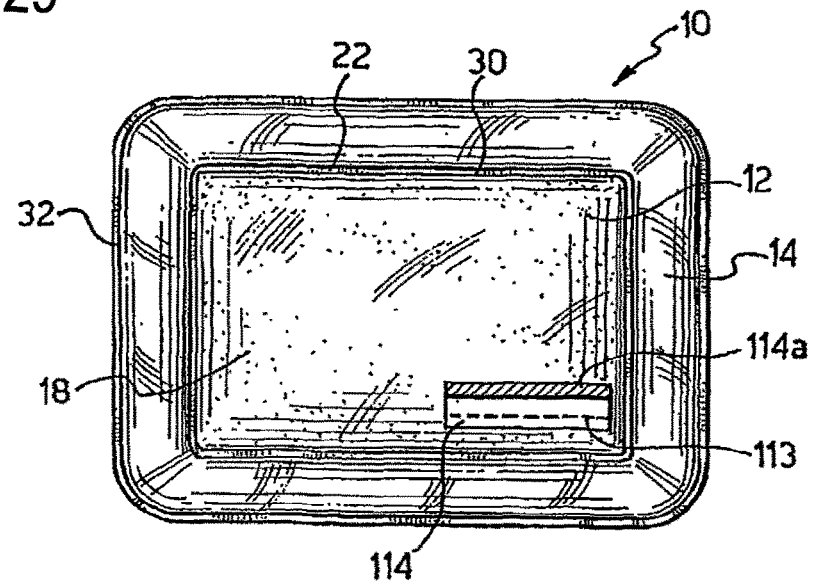
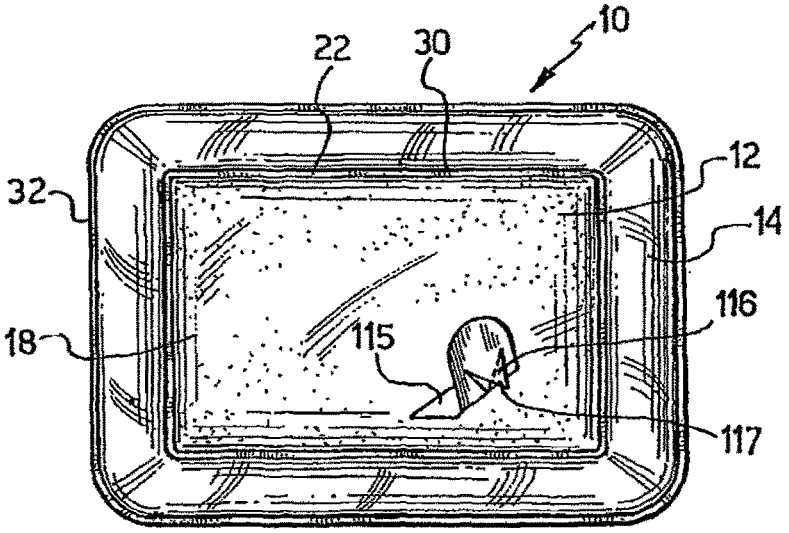
FIG.30

PACKAGE, PACKAGED PRODUCT, METHOD OF RELEASING AT LEAST ONE AGENT INTO CHAMBER PORTION OF PACKAGE, AND PROCESS OF PACKAGING

FIELD

The disclosure is related generally to package, packaged product, and method of releasing agent into chamber portion of package.

BACKGROUND

It is common in food packaging operations for a food product (e.g., fresh meat or fish) to be placed on a rigid tray (e.g., a thermoformed expanded polystyrene tray having a central depressed area and a surrounding peripheral flange). A thermoplastic film may then be positioned over the food and heat sealed to the peripheral flange to hermetically enclose the food product.

However, a high percentage of the final packaging costs for such packaging systems is due to the relatively high cost of such trays. In addition, the weight and volume of packaging remains quite high especially compared to the weight of the contained product, thus resulting in higher costs for shipping and storing. In general, there are costs and inconveniences associated with transporting and storing the trays before their use in the packages. Also, such trays add to the volume of packaging waste material with which the consumer must deal after opening the package.

Some end consumers may pay more attention to waste disposal, due to taxes imposed on in some countries based on per-capita waste. In addition, there is increased attention to preserve the environment and energy resources. There is exists an need for packaging that allows a reduction of the cost of a final package and the cost associated with the waste management and recovery.

There is also a desire for portioned and ready-to-be-consumed or used products, and a desire to be able to confer a specific aroma to a product or higher product safety before use or consumption. This is particularly the case of food products, especially proteins-based, in particular fish or meat, or personal care, hygiene or medical products.

There exists a trend of increased consumer attention to food product safety reduction of food waste. There also exists a trend of consumers wanting to confer a specific aroma to a product without the need for additional packaging.

SUMMARY

A first aspect is directed to a package for containing a product, the package comprising:

top and bottom opposing chamber films fixed together in a frangible chamber closure zone to define a chamber portion that is capable of containing the product; and a hollow frame adjacent to the chamber portion, wherein the hollow frame is capable of containing an agent, wherein the frangible chamber closure zone is between the chamber portion and the frame, and rupturing the frangible chamber closure zone allows the agent to flow from the frame to the chamber portion and contact the product.

In an embodiment, the frangible chamber closure zone has a release strength of 0.058 to 0.309 N/mm.

In an embodiment, both the top and bottom opposing chamber films are flexible.

In an embodiment, one film of the top and bottom chamber films includes a seal layer and a frangible layer adhered to the seal layer, the frangible layer comprises a frangible blend, the seal layer is adhered to the other film of the top and bottom chamber films within the frangible chamber closure zone In an embodiment, the frangible blend has a release strength of 0.058 to 0.309 N/mm.

In an embodiment, the chamber portion contains a product and the top and bottom chamber films are collapsed together under vacuum around the product.

In an embodiment, the chamber portion contains a product and the chamber portion includes a modified atmosphere around the product.

In an embodiment, the agent includes at least one selected from the group consisting of a biocide and an organoleptic substance.

In an embodiment, the agent includes at least one selected from the group consisting of ozone and chlorine dioxide.

In an embodiment, the frame comprises top and bottom opposing frame films fixed together at a frame outer closure zone proximate an outer side of the frame, the frame further comprises a frangible frame inner closure zone proximate the chamber portion, the frangible frame inner closure zone is coextensive with the frangible chamber closure zone.

In an embodiment, the frangible frame inner closure zone has a release strength of 0.058 to 0.309 N/mm.

In an embodiment, a lid film comprises both the top frame film and the top chamber film; a base film comprises both the bottom frame film and the bottom chamber film; and the lid and base films extend continuously from the frame to the chamber portion.

In an embodiment, the lid film is formed from a lid web and the base film is formed from a base web.

In an embodiment, the lid film is fixed to the base film at the frame outer closure zone.

In an embodiment, the top and bottom frame films are fixed together at the frame outer closure zone by applying heat to the frame outer closure zone.

In an embodiment, the frame comprises a rupturable agent director formed adjacent to the frangible chamber closure zone, the rupturable agent director is configured to direct the agent toward the product upon rupturing the frangible chamber closure zone.

In an embodiment, the agent director is conical, hemispherical, or spherical.

In an embodiment, the frangible chamber closure zone forms a boundary between the agent director and the chamber portion.

In an embodiment, the top and bottom chamber films each comprise one or more thermoplastic polymer materials.

In an embodiment, a packaged product comprises the package according to the first aspect; a product within the chamber portion; and at least one agent within the frame.

In an embodiment, the product includes a food.

In an embodiment, the food includes at least one selected from the group consisting of meat, fish, a vegetable, and a fruit.

In an embodiment, the frame comprises at least two cells, and different agents are included in separate cells of the at least two cells.

A second aspect is directed to a method of releasing at least one agent into a chamber portion of a package, the method comprising:

providing the at least agent in a hollow frame adjacent to the chamber portion; and rupturing a frangible closure between the chamber portion and the hollow frame to release the at least one agent contained in the hollow frame into the chamber portion.

In an embodiment, a product is provided in the chamber portion.

In an embodiment, the product includes a food.

In an embodiment, the food includes at least one selected from the group consisting of meat, fish, a vegetable, and a fruit.

In an embodiment, the frame comprises at least two cells, a first agent is provided in a first cell of the at least two cells, a second agent is provided in a second cell of the at least two cells, and the first agent is released into the chamber portion before the second agent is released into the chamber portion.

A third aspect is directed to a process of packaging comprising:

providing a base web comprising a material;

placing a product on the base web;

positioning over the product a lid web comprising a material;

fixing the lid web to the base web at a frangible chamber closure zone to form a chamber portion enclosing the product;

fixing the lid web to the base web at one or more frame closure zones to form a hollow frame adjacent to the chamber portion and adapted to support the chamber portion when the frame is inflated; and including an agent in the frame.

In an embodiment, the process further comprises folding at least a portion of the base web over the product to form the lid web.

In an embodiment, at least one of the frame closure zones is coextensive with the frangible chamber closure zone.

In an embodiment, fixing the lid web to the base web at the frangible chamber closure zone forms a chamber portion enclosing a modified atmosphere within the chamber portion.

In an embodiment, the process further comprises forming a vacuum in the chamber portion by evacuating an area configured to form the chamber portion before fixing of lid web to the base web at the frangible chamber closure zone.

In an embodiment, fixing the lid web to the base web at the one or more frame closure zones forms the hollow frame enclosing gas at a pressure above ambient pressure.

In an embodiment, the process further comprises introducing a modified atmosphere into the chamber portion.

In an embodiment, the process further comprises inflating the hollow frame.

In an embodiment, the process further comprises thermoforming at least a portion of the base web into a desired configuration before placing the product on the base web.

In an embodiment, the process further comprises thermoforming at least a portion of the lid web into a desired configuration before positioning the lid web over the product.

In an embodiment, the process further comprises at least partially unwinding a base web roll to provide the base web.

In an embodiment, the process further comprises at least partially unwinding a lid web roll to provide the lid web.

In an embodiment, the process further comprises severing the base web to form a package base web portion and a remaining base web portion, wherein: the hollow frame comprises the package base web portion; and the remaining base web portion is outside of the package base web portion.

In an embodiment, the process further comprises severing the lid web to form a package lid web portion and a remaining lid web portion, wherein: the hollow frame comprises the package lid web portion; and the remaining lid web portion is outside of the package lid web portion.

In an embodiment, fixing the lid web to the base web to form the chamber portion and fixing the lid web to the base web to form the frame are performed simultaneously.

BRIEF DESCRIPTION OF THE DRAWINGS

FIG. 1 is a plan view of an embodiment of a package having a frame in an inflated state and a modified atmosphere in a chamber portion;

FIG. 2 is a sectional view taken along line 2-2 of FIG. 1;

FIG. 3 is a plan view of an embodiment of a package wherein a frame is in interrupted by closures;

FIG. 4 is a plan view of an embodiment of a package;

FIG. 5 is a representative schematic of an embodiment of a process line for making a package;

FIG. 6 is a plan view of an embodiment of a package having a frame inflation passageway and a chamber inflation passageway;

FIG. 7 is a sectional view of an embodiment of a package having a thermoformed base film;

FIG. 8 is a sectional view of an embodiment of a package having a thermoformed base film and a thermoformed lid film;

FIG. 18 is a sectional view of an embodiment of a vacuum/gas-flush/heat closure/inflation chamber of FIG. 5 in the chamber open mode;

FIG. 19 is a sectional view of the chamber in FIG. 18 in the chamber close mode;

FIG. 20 is a sectional view of the chamber in FIG. 18 in the chamber portion closure mode;

FIG. 21 is a sectional view of the chamber in FIG. 18 in the frame closure mode;

FIG. 22 is a sectional view of the chamber in FIG. 18 in the chamber open mode with a formed package;

FIG. 23 is a sectional view of an embodiment of a vacuum/gas-flush/heat closure/inflation chamber for use in forming vacuum skin packaging;

FIG. 24 is a sectional view of an embodiment of a thermoforming station;

FIG. 25 is a sectional view of an embodiment of a thermoforming station;

FIG. 27 is a sectional view of an embodiment of a thermoformed base film suitable for the manufacture of a package;

FIG. 28 is a plan view of a base film thermoformed as illustrated in FIG. 27;

FIGS. 29, 30, and 31, are plan views of embodiments of a package.

DETAILED DESCRIPTION

Figure 9:
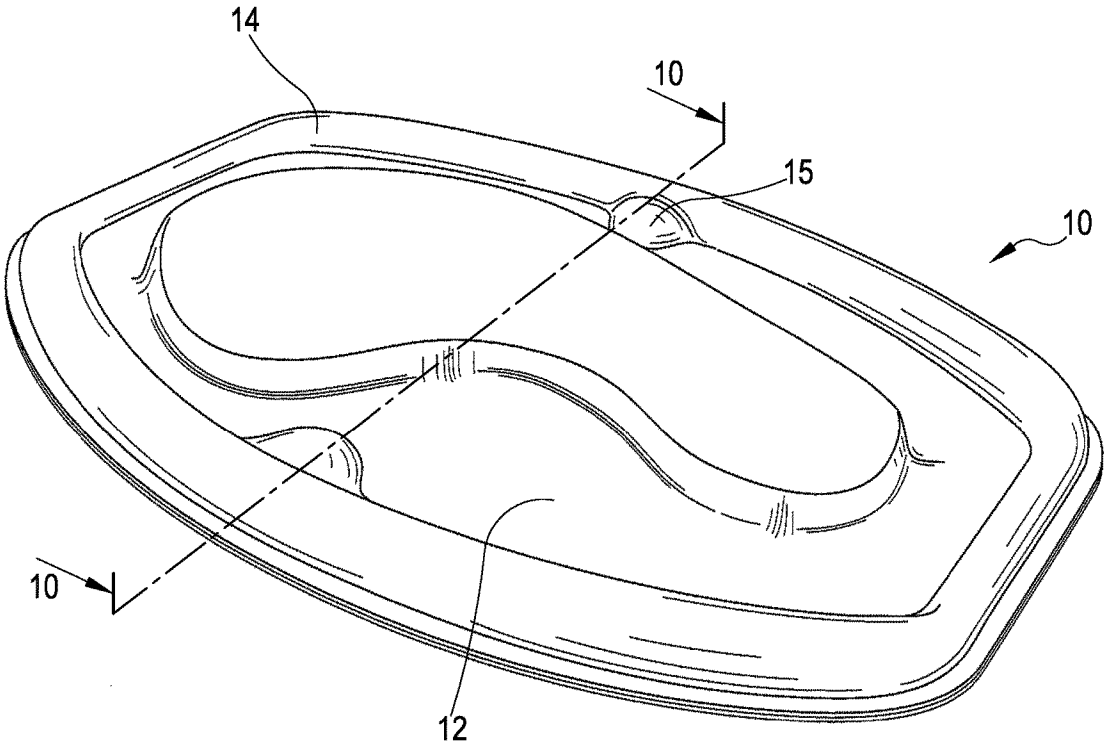
FIG. 9 is a perspective view of an embodiment of a package.

A "package" as described herein may be useful for packaging of products, e.g. food products and non-food products.

As used herein, "food products" includes, but is not limited to, protein-based foods, e.g., raw, cooked, or partially cooked meat and fish, as well as vegetables, fruits, etc.

As used herein, the term "film" is inclusive of a plastic film or a plastic sheet. Films may comprise one or more layers of thermoplastic polymer materials such as, for example, polyolefins, polystyrenes, polyurethanes, polyamides, polyesters, polyvinyl chlorides, ionomers, ethylene vinyl-acetate (EVA), ethylene vinyl alcohol (EVOH), and blends thereof. Film is also inclusive of any of the top and bottom chamber films 18 (118), 20 (120), top and bottom frame films 26 (126), 28 (128), and lid and base films 34 (134), 36 (136).

Useful polyolefins include ethylene homo- and co-polymers and propylene homo- and co-polymers. Ethylene homopolymers include high density polyethylene ("HDPE"), a polyethylene with a density higher than 0.94 g/cm$^3$, typically comprised between 0.94 and 0.96 g/cm$^3$, medium density polyethylene ("MDPE"), a polyethylene with density typically comprised between 0.93 and 0.94 g/cm$^3$, and low density polyethylene ("LDPE") a polyethylene with density below 0.93 g/cm$^3$. Ethylene copolymers include ethylene/alpha-olefin copolymers ("EAOs") and ethylene/unsaturated ester copolymers ("copolymer" as used herein is inclusive of a polymer derived from two or more types of monomers, and includes terpolymers, etc.)

EAOs may include copolymers of ethylene and one or more alpha-olefins, the copolymer having ethylene as the majority mole-percentage content. The comonomer may include one or more $C_3$-$C_{20}$ $\alpha$-olefins, such as one or more $C_4$-$C_{12}$ $\alpha$-olefins, or one or more $C_4$-$C_8$ $\alpha$-olefins. Useful $\alpha$-olefins include 1-butene, 1-hexene, 5-methyl-1-pentene, 1-octene, and mixtures thereof.

EAOs include one or more of the following: linear medium density polyethylene ("LMDPE"), for example having a density of from 0.926 to 0.94 g/cm$^3$, linear low density polyethylene ("LLDPE"), for example having a density of from 0.915 to 0.930 g/cm$^3$, and very-low or ultra-low density polyethylene ("VLDPE" and "ULDPE"), for example having density below 0.915 g/cm$^3$. Unless otherwise indicated, all densities herein are measured according to ASTM D1505.

The polyethylene polymers and copolymers may be either heterogeneous or homogeneous. As is known in the art, heterogeneous polymers may have a relatively wide variation in molecular weight and composition distribution; whereas, homogeneous polymers may have a relatively narrow variation in molecular weight and composition distribution. Heterogeneous polymers may be prepared with, for example, conventional Ziegler Natta catalysts. Homogeneous polymers may be prepared using metallocene or other single site-type catalysts.

Another useful ethylene copolymer is ethylene/unsaturated ester copolymer, which is the copolymer of ethylene and one or more unsaturated ester monomers. Useful unsaturated esters include vinyl esters of aliphatic carboxylic acids, containing from 4 to 12 carbon atoms (e.g., vinyl acetate), and alkyl esters of acrylic or methacrylic acid (collectively, "alkyl (meth)acrylate"), containing from 4 to 12 carbon atoms.

Useful propylene copolymer includes propylene/ethylene copolymers ("EPC"), which are copolymers of propylene and ethylene having a majority weight % content of propylene, such as those having an ethylene comonomer content of less than 10%, less than 6%, or even from about 2% to 6% by weight; and propylene-ethylene-butene terpolymers (or propylene-ethylene-higher $\alpha$-olefin terpolymers) having a majority wt. % of propylene, such as those having a total amount of ethylene and butene (or ethylene and higher $\alpha$-olefin) of less than 25 wt. %, or even less than 20 wt. %. Also the propylene polymers can be heterogeneous or homogeneous.

Useful polyamides include both homo-polyamides or co-(ter- or multi-) polyamides, which may be aliphatic, aromatic or partially aromatic. The homopolyamides may be derived from the polymerisation of a single type of monomer comprising both the chemical functions which are typical of polyamides, i.e. amino and acid groups, such monomers being typically lactams of amino-acids, or from the polycondensation of two types of polyfunctional monomers, i.e. polyamines with polybasic acids. The co-, ter-, and multi-polyamides on the other hand may be derived from the copolymerisation of precursor monomers of at least two (three or more) different polyamides, e.g. two different lactams, or two types of polyamines and/or polyacids, or a lactam on the one side and a polyamide and a polyacid on the other. Examples of suitable polyamides are PA 6, PA 6/66, PA 6/I2, PA 6I/6T, PA MXD6, PA MXD6/MXDI, and the like polyamides.

Examples of useful polyesters include amorphous (co) polyesters, comprising an aromatic dicarboxylic acid, e.g. terephthalic acid, naphthalenedicarboxylic acid, and isophthalic acid, as the main dicarboxylic acid component and an aliphatic glycol, e.g., ethylene glycol, trimethylene glycol, tetramethylene glycol, optionally admixed with an alicyclic glycol, such as cyclohexane dimethanol, as the main glycol component. Polyesters with at least about 75 mole percent, or even at least about 80 mole percent, based on the total of the dicarboxylic acid component, of terephthalic acid may used.

As reported above, any of the films may be mono- or multi-layered. If a film is multilayered, then the film may include one or more outer layers of a heat-sealable material to assist in heat sealing the films together, as is known in the art. Such a seal layer may include one or more of the thermoplastic polymers discussed above.

It may be advantageous for any, or one or more, of the films to have gas (e.g., oxygen, carbon dioxide) barrier attributes to decrease the gas permeability of the film. Barrier attributes for the films may be useful, for example to increase the inflated life of frame 14, to enhance the storage life of a packaged product 16 contained within chamber portion 12 that may degrade upon exposure to oxygen (e.g., red meat), and to help maintain a modified atmosphere 24 or a vacuum that may be contained within chamber portion 12.

Any, or one or more, of the films may therefore comprise one or more materials ("barrier components") that markedly decrease the oxygen or carbon dioxide transmission rate through the film and thus impart barrier attributes to the film. (Since carbon dioxide barrier properties generally correlate with oxygen barrier properties, only oxygen barrier properties are discussed in detail herein.) Examples of barrier components include: ethylene/vinyl alcohol copolymer ("EVOH"), polyvinyl alcohol ("PVOH"), vinylidene chloride polymers ("PVdC"), polyalkylene carbonate, polyester (e.g., PET, PEN), polyacrylonitrile ("PAN"), and polyamide. Barrier materials may include EVOH, PVDC, polyamides and blends of EVOH and polyamides.

EVOH may have an ethylene content of between about 20% and 40%, between about 25% and 35%, or even about 32% by weight. EVOH may include saponified or hydrolyzed ethylene/vinyl acetate copolymers, such as those having a degree of hydrolysis of at least 50%, or even at least 85%.

Vinylidene chloride polymer ("PVdC") is inclusive of a vinylidene chloride-containing copolymer, that is, a polymer that includes monomer units derived from vinylidene chloride ($CH_2{=}CCl_2$) and monomer units derived from one or more of vinyl chloride, styrene, vinyl acetate, acrylonitrile, and $C_1$-$C_{12}$ alkyl esters of (meth)acrylic acid (e.g., methyl acrylate, butyl acrylate, methyl methacrylate). As is known in the art, one or more thermal stabilizers, plasticizers and lubricating processing aids may be used in conjunction with PVdC.

If a film is multilayered, then the one or more layers of the film that incorporate barrier components in an amount sufficient to notably decrease the oxygen permeability of the film are considered "barrier layers". If the film is monolayered, then the barrier components may be incorporated in the sole layer of the film and the film itself may be considered a "barrier layer".

A useful barrier layer may have a thickness and composition sufficient to impart to the film incorporating the barrier layer an oxygen transmission rate of no more than about any of the following values: 150, 100, 50, 45, 40, 35, 30, 25, 20, 15, 10, and 5 cubic centimeters (at standard temperature and pressure) per square meter per day per 1 atmosphere of oxygen pressure differential measured at 0% relative humidity and 23° C. All references to oxygen transmission rate in this application are measured at these conditions according to ASTM D-3985. For example, top and bottom chamber films 18 (118), 20 (120) as well as top and bottom frame films 26 (126), and 28 (128), may each have a thickness and composition sufficient to impart to each of the films any of the oxygen transmission rates previously recited. Top and bottom chamber films 18 (118), 20 (120) as well as top and bottom frame films 26 (126), and 28 (128) may also be flexible.

Films may be made of a flexible multi-layer material comprising at least a first and outer heat-sealable layer, an optional intermediate gas barrier layer, and a second and outer heat-resistant layer. The outer heat-sealable layer may comprise a polymer capable of welding to the inner surface of the supports carrying the products to be packaged, such as for instance ethylene homo- or copolymers, like LDPE, ethylene/alpha-olefin copolymers, ethylene/acrylic acid copolymers, ethylene/methacrylic acid copolymers, and ethylene/vinyl acetate copolymers, ionomers, co-polyesters, e.g. PETG. The optional intermediate gas barrier layer may comprise oxygen impermeable resins like PVDC, EVOH, polyamides and blends of EVOH and polyamides. The outer heat-resistant layer may be made of ethylene homo- or copolymers, ethylene/cyclic-olefin copolymers, such as ethylene/norbornene copolymers, propylene homo- or copolymers, ionomers, (co)polyesters, (co)polyamides. The film may also comprise other layers such as adhesive layers or bulk layers to increase thickness of the film and improve its abuse and deep drawn properties. Particularly used bulk layers are ionomers, ethylene/vinyl acetate copolymers, polyamides and polyesters.

Additional tie layers, well known in the art, may be added to improve interlayer adhesion.

In any of the film layers, the polymer components may contain appropriate amounts of additives normally included in such compositions. Some of these additives may be included in the outer layers or in one of the outer layers, while some others may be added to inner layers. These additives include slip and anti-block agents such as talc, waxes, silica, and the like, antioxidants, stabilizers, plasticizers, fillers, pigments and dyes, cross-linking inhibitors, cross-linking enhancers, radiation stabilizers, UV absorbers, odor absorbers, oxygen scavengers, bactericides, antistatic agents, etc. One or more layers of the films can be cross-linked to improve the strength of the films and/or heat resistance of the films. Cross-linking may be achieved by using chemical additives or by subjecting the film layers to an energetic radiation treatment.

A heat-shrinkable film can be prepared by being oriented at a temperature above the softening point of the film, but at a temperature below the melting point of the film. This solid state orientation produces an oriented structure having built-in stresses so that upon reheating the film to its softening temperature, i.e., the orientation temperature, the film will undergo free shrink, i.e., unrestrained shrink e.g., as when the film is passed through a shrink tunnel.

On the other hand, a heat-shrinkable film may be annealed or heat-set to reduce the free shrink either slightly, substantially, or completely. Heat setting and annealing are carried out by heating the film to its orientation temperature while the film is restrained to prevent it from shrinking. In this manner, the stresses are relaxed out of the film without dimensional change in the film.

Free shrink is measured in accordance with ASTM D 2732, the content of which is incorporated herein by reference in its entirety. Using ASTM D 2732, the free shrink of the film is determined by measuring the percent dimensional change in a 10 cm×10 cm film specimen when immersed in water at the designated shrink temperature, for a period of 5 seconds.

As used herein, the phrase "heat-shrinkable" refers to any film that exhibits a total free shrink of at least 10% at 85° C., wherein the free shrink is measured in accordance with ASTM D 2732. As used herein, the phrase "non-heat-shrinkable" refers to any film that exhibits a total free shrink of less than 10% at 85° C., wherein the free shrink is measured in accordance with ASTM D 2732. The phrase "total free shrink" refers to sum of the free shrink in the longitudinal direction and the transverse direction, i.e., the total free shrink is the L+T free shrink.

A film may be heat-shrinkable, or non-heat-shrinkable. If the film is heat shrinkable, it can exhibit free shrink in just the longitudinal L direction (i.e., "L," also referred to as the "machine direction", i.e., "D"), or in just the transverse direction ("T"), or in both the L and T directions. The transverse direction is perpendicular to the longitudinal direction.

In an embodiment, the film is not heat-shrinkable.

The film can be non-heat-shrinkable, i.e., have a total free shrink at 85° C. of less than 10%. In an embodiment, the film can have a total free shrink of less than 8%, or even less than 5%.

If heat shrinkable, a film can have a total free shrink at 85° C. of at least 10%, or at least 20%, or at least 30%, or at least 40%, or at least 50% or at least 6'%. The film may have a total free shrink at 85° C. within any of the following ranges: from 10% to 150%, from 20% to 140%, or from 30% to 130% or from 40% to 120%.

Films may have a thickness from about 0.5 to about 12 mils (about 13 μm to about 305 μm), from about 0.5 to about 10 mils (about 13 μm to about 254 μm), from about 1 to about 9 mils (about 25 μm to about 229 μm), or even from about 2 to about 8 mils (about 51 μm to about 203 μm).

Films may have one or more of the characteristics selected from flexible, stretchable, extendable, and elastic. For example, a film may be stretched by being subject to inflation or vacuum. The films may exhibit a Young's modulus sufficient to withstand the expected handling and use conditions. Young's modulus may be measured in accordance with one or more of the following ASTM procedures: D882; D5026-95a; D4065-89, the contents of each of which is incorporated herein by reference in their entirety. Any or all of the films may have a Young's modulus of at least about any of the following values: 100 MPa, 200 MPa, 300 MPa, and 400 MPa, measured at 100° C. The Young's modulus for the films may also range from about 70 to about 1000 MPa, or even from about 100 to 500, measured at 100° C.

Films may be oriented in either the machine (i.e., longitudinal) or the transverse direction, or in both directions (i.e., biaxially oriented), in order to reduce the permeability and to increase the strength and durability of the film. For example, a film may be oriented in at least one direction by a ratio of any of the following: at least 2.5:1, from about 2.7:1 to about 10:1, at least 2.8:1, at least 2.9:1, at least 3.0:1, at least 3.1:1, at least 3.2:1, at least 3.3:1, at least 3.4:1, at least 3.5:1, at least 3.6:1, and at least 3.7:1.

Useful films may be selected from one or more of the films disclosed in International Patent Application Publication No. WO 01/68363 A1 and U.S. Pat. No. 6,299,984, the contents of both of which is incorporated herein by reference in their entirety.

As used herein, "easy open" is inclusive of an opening mechanism of a package, wherein the mechanism allows the package to be opened by manually pulling apart two materials of the package, e.g. pulling apart a film from another film, pulling apart a film from a base member, e.g. tray, etc. A film or a base member may be provided with a suitable composition that allows easy opening of the package. A sealant composition and/or a composition of an adjacent layer of a base member and/or a film may be adjusted in order to provide an easy opening mechanism.

As used herein, "peelable" easy open mechanism is inclusive of an opening mechanism that allows a package to be opened by separating the two parts, e.g., films, at an interface between the parts. A release strength of a peelable easy open mechanism may be controlled by an appropriate choice of the chemical similarity or dissimilarity of the layers of the upper and lower parts of a package that are fixed together. The release strength of a peelable easy open mechanism may also be increased by increasing the amount of heat and/or pressure applied when fixing parts of a package together, and the release strength of the peelable easy open mechanism may be decreased by decreasing the amount of heat applied when fixing parts of a package together. A release strength obtained by using a peelable easy open mechanism may be in the range of from about 1.47 N/25.4 mm to about 7.85 N/25.4 mm (about 0.058 to 0.309 N/mm), in the range of from about 2.00 to about 6.00 N/25.4 mm (about 0.079 to 0.236 N/mm), or even in the range of from about 2.50 to about 5.00 N/25.4 mm (about 0.098 to 0.197 N/mm).

As used herein, "release strength" is inclusive of a force per unit distance that is sufficient to cause the separation of at least to two materials that are fixed together or to cause a material to cohesively separate. For example, release strength may be evaluated using the following procedure. Strips having a width of 25.4 mm and a length of 300 mm may cut from an area of a package where two materials are fixed together, for example during a vacuum skin cycle. The two materials may be separated, e.g., an upper material from a lower material by attaching the lower material to a lower clamp of a dynamometer and attaching the upper material to an upper clamp, taking care that the area to be tested is between the two clamps and that an adequate tension exists between the two extremities of the fixed sample. The release strength may then be measured with a crosshead speed of 200 mm/min and a jaw distance of 30 mm.

As alternative, ASTM F904 or ASTM F88 may be used to test release strength.

Alternatively, especially in case of packaging including a modified atmosphere around a product, the release strength can be measured according to ASTM F 904 the contents of which is incorporated herein by reference in their entirety.

Such tests allow the selection of the top and bottom film as well as the machine setting conditions.

As used herein, "adhesive failure" easy open mechanism is inclusive of an opening mechanism that allows a package to be opened through an initial breakage through the thickness of one of the seal layers followed by delamination of this layer from the underlying support or film. An example of adhesive failure easy open mechanism is a system where the seal layers of both the upper and lower films are made from polyethylene and one of the seal layers is adhered to a polyamide surface. The low bond between polyethylene and polyamide permits the delamination to take place during the opening of the package. When the delamination reaches the area of the packed products, a second breakage through the seal layer takes place. As a result the entire seal layer of one of the two webs is separated from one of the webs and is left sealed to the opposite web. The release strength in an adhesive failure easy open mechanism may depend on the chemical similarity or dissimilarity of the two materials. Coextrusion conditions such as pressure, temperature and time of contact between the molten materials may also have a major effect on the final bond strength between the two layers in adhesive failure easy open mechanism.

A "cohesive failure" easy open mechanism is inclusive of an opening mechanism that allows a package to be opened through internal rupture of a seal layer that, during opening of the package, breaks along a plane parallel to the layer itself.

In addition, a frangible blend may be used in a seal layer or a frangible layer directly adhered to a seal layer in order to provide an easy open mechanism of a package. Such a blend is described in EP1084186, the content of which is incorporated herein by reference in its entirety.

An embodiment of a frangible blend comprises:

(i) a copolymer of ethylene and acrylic acid or methacrylic acid, (ii) a modified EVA copolymer, and (iii) a polybutylene.

In an embodiment, the frangible blend consist of the components (i), (ii) and (iii) indicated herein.

The term "copolymer of ethylene and acrylic acid or methacrylic acid" is inclusive of a copolymer of ethylene with a copolymerisable ethylenically unsaturated carboxylic acidic monomer selected from acrylic acid and methacrylic acid. The copolymer may contain from about 4% to about 18% by weight of acrylic or methacrylic acid units. The copolymer may also contain, copolymerized therein, an alkyl acrylate or methacrylate, such as n-butyl acrylate or methacrylate or isobutyl acrylate or methacrylate. The copolymer may be in the free acid form as well as in the ionized or partially ionized form wherein the neutralizing cation may be any suitable metal ion, e.g., an alkali metal ion, a zinc ion, or other multivalent metal ions; in this latter case the copolymer is also termed "ionomer".

Component (i) of the frangible blend may be an ionomer. The polymers may have a low melt flow index of less than 5, or even less than 2. The polymers may be ionomeric resins with an acid content of up to 10%. Such polymers are commercially available as Surlyn™ (by DuPont).

The term "modified EVA" is inclusive of ethylene-vinyl acetate based copolymer that may be modified either by the presence of a third unit, such as CO, in the polymer chain or by blending therewith or grafting thereon another modifying component.

Useful terpolymers may be obtained by the copolymerization of ethylene, vinyl acetate and carbon monoxide, as those described in, e.g., U.S. Pat. No. 3,780,140, the content of which is incorporated herein by reference in its entirety. The terpolymers may comprise 3-30 wt. % of units deriving from carbon monoxide, 40-80 wt. % of units deriving from ethylene and 5-60 wt. % of units deriving from vinyl acetate.

Alternatively, modified EVA resins may include ethylene-vinyl acetate copolymers grafted with carboxylic or anhydride functionalities, such as, for example, EVA grafted with maleic anhydride.

The difference between the melt flow indices of polymer (i) and of polymer (ii) in the frangible blend may be at least 5, at least 10, at least 15, or even at least 20. MFI are measured under the conditions E of ASTM D 1238.

The terms "polybutene" or "polybutylene" are inclusive of homo and copolymers consisting essentially of a butene-1, butene-2, isobutene repeating units as well as ethylene-butene copolymers. Ethylene-butene copolymers may be used.

By using the frangible blend, due to an internal incompatibility, a low easy opening strength is provided and that additionally the average value has a low % variation.

The frangible blend may be obtained by thoroughly mixing the three components in powder form and then melt extruding the blend.

In an embodiment, the frangible blend comprises from about 35 wt. % to about 83 wt. % of a copolymer of ethylene and acrylic acid or methacrylic acid (i), from about 15 wt. % to about 30 wt. % of a modified ethylene/vinyl acetate copolymer (ii) and of from about 2 wt. % to about 50 wt. % of a polybutylene (iii).

The frangible blend may be made of a mixture of from about 45 wt. % to about 75 wt. % of a copolymer of ethylene and acrylic acid or methacrylic acid (i), of from about 20 wt. % to about 30 wt. % of a modified ethylene/vinyl acetate copolymer (ii) and of from about 5 wt. % to about 25 wt. % of a polybutylene (iii).

The frangible blend may be used as a layer of a mono or preferably a multilayer film.

In an embodiment a seal layer comprises the above described frangible blend. In an embodiment a layer directly adhering to a seal layer comprises the above described frangible blend.

The release strength obtained by using the frangible blend in a film according to the present invention may be in the range of from about 1.47 N/25.4 mm to about 7.85 N/25.4 mm (about 0.058 to 0.309 N/mm), in the range of from about 2.00 to about 6.00 N/25.4 mm (about 0.079 to 0.236 N/mm), or even in the range of from about 2.50 to about 5.00 N/25.4 mm (about 0.098 to 0.197 N/mm). The release strength may be increased by increasing the amount of heat and/or pressure applied to the frangible blend when fixing parts of a package together, and the release strength may be decreased by decreasing the amount of heat applied to the frangible blend when fixing parts of a package together.

The % variation (3σ) on the average value of the easy opening strength is lower than about 55%, or even lower than 35%, thus affording reproducible easy open packages.

A package may comprise the frangible blend either in the seal layer, or as a frangible layer directly contacting to the seal layer.

If the layer comprising the frangible blend is not the seal layer, the seal layer may comprise a polyolefin. The film may comprise at least one member selected from the group consisting of ethylene-alpha olefin copolymers, LDPE, MDPE, HDPE, ethylene-acrylic acid copolymer (EAA), ethylene/methacrylic acid copolymer (EMAA), ethylene vinyl acetate copolymer (EVA) and ionomer.

In addition to a seal layer comprising the frangible blend or in addition to the seal layer and the frangible layer comprising the frangible blend adhered to the seal layer, the film may also comprise at least another layer, adhered to the surface of the frangible layer which is not adhered to the seal layer.

As used herein, the terms "closure" and "closure zone" are inclusive of a location where at least two parts of a package are fixed together by heat sealing (e.g., conductance sealing, impulse sealing, ultrasonic sealing, dielectric sealing), by adhesive (e.g., a UV-curable adhesive), by a peelable easy open mechanism, by an adhesive failure easy open mechanism, by a cohesive failure easy open mechanism, by a structure including a frangible blend, etc.

FIGS. 1 and 2 illustrate an embodiment of package 10 comprising chamber portion 12 circumscribed by hollow frame 14. Chamber portion 12 may be "watertight" (i.e., does not permit leakage or permeation of liquid water except if subjected to structural discontinuity) and further it may be "airtight" or "hermetic" (i.e., does not permit permeation of oxygen at a rate above 1000 cubic centimeters (at standard temperature and pressure) per square meter per day per 1 atmosphere of oxygen pressure differential measured at 0% relative humidity and 23° C., unless subjected to structural discontinuity). Chamber portion 12 is capable of containing product 16. Chamber portion 12 may include top chamber film 18 and bottom chamber film 20, which may be juxtaposed and fixed together at frangible chamber closure zone 22 to form chamber portion 12. The terminology "top" and "bottom" films as used herein is inclusive of one film of material folded over upon itself to form the top and bottom films.

In the embodiment illustrated in FIGS. 1 and 2, hollow frame 14 is shown in an inflated state, and hollow frame circumscribes chamber portion 12. Frame 14 is adapted to support chamber portion 12 when frame 14 is inflated. When frame 14 is inflated, an agent may be included inside frame. The agent may be a biocide, an organoleptic substance, etc. The agent may be in the form of a gas, liquid, or solid.

The substances listed in FSIS Directive 1720.1, Revision 15, Apr. 30, 2013, U.S. Dept. of Agriculture Food Safety and Inspection Service, the content of which is incorporated herein by reference it its entirety, may be used as an agent.

Biocides may include antibacterial materials, fungicides, antiviral substances, antimicrobial substances, antibiotic substances, santizers, disinfectants, cleaners, oxidizing agents, etc. that are useful as an agent. Examples of a biocidal agents are chlorine dioxide and ozone. Organoleptic substances that are useful as an agent are inclusive of colorants, seasonings, volatile materials, fat sources, etc. Colorants are inclusive of both natural and synthetic food colorings, etc. Seasonings that are useful as an agent are inclusive of rosemary, thyme, basil, allspice, mustard, cardamom, chili pepper, cayenne pepper, chives, cilantro, cinnamon, clove, coriander, cumin, curry, dill, fennel, garlic, ginger, horseradish, jasmine, licorice, oregano, nutmeg, paprika, parsley, pepper, peppermint, tumeric, vanilla, wasabi, wintergreen, salt, etc. Fat sources are inclusive of corn oil, canola oil, olive oil, coconut oil, palm oil, sunflower oil, sesame oil, peanut oil, safflower oil, avocado oil, cottonseed oil, flaxseed oil, grape seed oil, soybean oil, butter, lard, margarine, etc. Volatile materials are inclusive of aroma molecules and flavorants which include terpenes, phenolics, aldehydes, alcohols, olefins, ketones, esters, lactones, sulfurous and nitrous compounds, known to impart specific flavor and aroma characteristics, such as the following: those listed on pages 1-98 in the Aldrich Flavors & Fragrances Catalogue (Aldrich Flavors & Fragrances Catalogue, 1996, Aldrich Chemical Company, Milwaukee, Wis., USA), the content of which is incorporated herein by reference in its entirety; those listed on pages 3-37 of the Bedoukian Distinctive Perfume and Flavor Ingredients Catalogue, (Bedoukian Distinctive Perfume and Flavor Ingredients Catalogue 1997-1998, Bedoukian Research Inc., Danbury, Conn., USA.), the content of which is incorporated herein by reference in its entirety; and the synthetic flavorants listed in Volume 2, pages 3-800 and the natural flavorants listed in Volume 1, pages 23-294 of Fenaroli's Handbook of Flavor Ingredients (Burdock G A ed. 1995. 3rd edition. CRC Press. Boca Raton), the content of which is incorporated herein by reference in its entirety.

Frame 14 may be in form of a continuous tube surrounding chamber portion 12, as shown in FIG. 1. Furthermore, the continuous tube may be interrupted by one or more closures 23, as illustrated in FIG. 3. In addition, the frame may be formed on one or more sides of the chamber portion without surrounding the chamber portion.

When frame 14 is interrupted by more than one closure 23, the closures 23 create two or more discrete frame cells 21, 25, and 31. One advantage of having discrete frame cells is in the possibility that one frame cell may deflate without deflating the entire frame. Another advantage of having discrete frame cells is in the option of including different agents in separate frame cells. In the embodiment that is illustrated in FIG. 3, closures 23 are disposed symmetrically along the frame in order to avoid or prevent as much as possible any distortion of the end package. In embodiments of packages having substantially rectangular or square shape, e.g., as illustrated in FIG. 3, closures may be positioned in the corners.

In an embodiment illustrated in FIG. 4, the one or more closures 23 may contain continuous or discontinuous (perforated) cuts 123 formed within the closures. The advantage of this embodiment resides in the possibility for the end user to easily open the package by grasping by hands the two edges of the frame that are separated by cuts 123 and tearing them apart, thus using the cut as a notch. This can be done with or without prior deflation of the frame, in case of a single cut, or of two discrete cells, e.g., 25 and 21, of the frame that are adjacent to the cut used as the package notch.

Frame 14 may include a top frame film 26 and a bottom frame film 28, which may be juxtaposed and fixed together at a frangible frame inner closure zone 30 and a frame outer closure zone 32 to form frame 14.

As illustrated in FIG. 2, lid film 34 extends continuously from the frame to the chamber portion, thereby including both top chamber film 18 and top frame film 26. Also as illustrated in FIG. 2, base film 36 extends continuously from the frame 14 to the chamber portion 12, thereby including both bottom chamber film 20 and bottom frame film 28. The lid film 34 may be formed from a lid web and the base film 36 may be formed from a base web. As used herein, a "web" is inclusive of a continuous length of film material handled in roll form, as contrasted with the same material cut into short lengths.

As illustrated in FIG. 2, frame 14 is attached to the chamber portion 12 by virtue of lid film 34 and base film 36, which extend continuously from frame 14 to chamber portion 12 to attach frame 14 to chamber portion 12. Either or both of the lid and base films may extend continuously from the frame to the chamber portion to attach the frame 14 to the chamber portion 12.

Frangible frame inner closure zone 30 may be coextensive with frangible chamber closure zone 22, as illustrated in FIGS. 1 and 2. Alternatively, the frangible frame inner closure zone 30 may be spaced apart from frangible chamber closure zone 22 or may be adjacent to frangible chamber closure zone 22. If lid film 34 is fixed to base film 36 so that frangible frame inner closure zone 30 is coextensive with frangible chamber closure zone 22, then the frame 14 and chamber portion 12 may share a common closure, as illustrated in FIG. 2. In such case, the frangible frame inner closure zone 30 may be said to include or comprise frangible chamber closure zone 22—or frangible chamber closure zone 22 may be said to include or comprise frangible frame inner closure zone 30.

A single type of agent or a combination of two or more agents may be placed in a frame 14. In addition, a single type of agent or a combination of two or more agents may be placed in the frame chambers 25 illustrated FIGS. 3 and 4.

The films (i.e., top and bottom chamber films, top and bottom frame films, lid and base films) may be fixed together at any of the closure zones (e.g., frangible chamber closure zone 22, the frangible frame inner closure zone 30, and the frame outer closure zone 32).

FIGS. 1 and 2 illustrate an embodiment of package 10 containing product 16, e.g., meat, as follows. Package 10 includes top and bottom opposing chamber films 18 and 20 fixed together in frangible chamber closure zone 22 to define chamber portion 12 that contains product 16. Package 10 also includes hollow frame 14 adjacent to chamber portion 12, and frame contains an agent, e.g. ozone. Frangible chamber closure zone 22 is between chamber portion 12 and frame 14, and rupturing frangible chamber closure zone 22 allows agent to flow from frame 14 to chamber portion 12 and contact product 16. Frangible chamber closure zone 22 has a release strength of 0.058 to 0.309 N/mm. Frame comprises top and bottom opposing frame films 26 and 28 fixed together at frame outer closure zone 32 proximate outer side of the frame. Frame further comprises frangible frame inner closure zone 30 proximate chamber portion 12. Frangible frame inner closure zone 30 is coextensive with frangible chamber closure zone 22, and frangible frame inner closure zone has a release strength of 0.058 to 0.309 N/mm. Package 10 further includes lid film 34 comprising both top frame film 26 and top chamber film 18, base film 36 comprising both bottom frame film 28 and bottom chamber film 20; and lid and base films 34 and 36 extend continuously from frame 14 to chamber portion 12. Lid film 34 is formed from lid web (discussed below) and base film 36 is formed from base web (discussed below). Lid film 34 is fixed to base 36 film at frame outer closure zone 32. When sufficient force is applied to frame 14, frangible chamber closure zone 22 and frangible frame inner closure zone 30 rupture and films adhered together in frangible chamber closure zone 22 and in frangible frame inner closure zone 30 separate to allow agent to flow from frame 14 and into chamber portion 12.

Frangible chamber closure zone 22 and frangible frame inner closure zone 30 may be ruptured by applying enough pressure to frame 14 to result in a force of equal to greater than a release strength of 0.058 to 0.309 N/mm being applied to frangible chamber closure zone 22 and frangible frame inner closure zone 30.

In an embodiment, an agent may be enclosed within a chamber of frame 14 illustrated in FIGS. 1-4, such that the agent does not leak out of the frame unless the agent is released into chamber portion 12 by rupturing frangible chamber closure zone 22 and frangible frame closure zone 30.

An embodiment of a method of releasing the agent into chamber portion 12 of package 10 illustrated in FIGS. 1-4 comprises providing the agent in hollow frame 14 adjacent to chamber portion 12; and rupturing a frangible closure (e.g. frangible chamber closure zone 22 and frangible frame inner closure zone 30) between chamber portion and hollow frame to release the agent into chamber portion. Furthermore, a product 16, e.g., a piece of meat, may be included in chamber portion when releasing the agent into the chamber portion.

An embodiment of a method of releasing the agent into chamber portion 12 of package 10 illustrated in FIGS. 3 and 4 comprises providing a different type of agent in each of at least two of discrete frame cells 21, 25, and 31 of hollow frame 14 adjacent to chamber portion 12; and rupturing a frangible closure (e.g. frangible chamber closure zone 22 and frangible frame inner closure zone 30) between chamber portion and discrete frame cells 21, 25, and 31 to release agents into chamber portion. Furthermore, a product 16, e.g., a piece of meat, may be included in chamber portion when releasing the agent into the chamber portion. A different agent, e.g., a biocide, may be released from one cell, e.g., 25, and into chamber portion 12, and subsequently, another agent, e.g., aroma molecules, may be released from separate cell, e.g., 21 and into chamber portion 12.

FIG. 6 illustrates an embodiment of package 10 including a frame inflation passageway 42 attached to frame 14 to provide access to the interior of hollow frame 14 for inflating the frame. Accordingly, frame inflation passageway 42 may be connected to one or more portions of frame 14 and be in fluid communication with the interior space of frame 14. An agent may be placed in frame 14 through frame inflation passageway 42. A chamber inflation passageway 44 may be attached to chamber portion 12 to provide access to the interior space of chamber portion 12 for introducing a modified atmosphere into the interior space of chamber portion 12. Chamber inflation passageway 44 may be connected to one or more portions of chamber portion 12 and be in fluid communication with the interior space of chamber portion 12. Examples of frame inflation passageway 42 and chamber inflation passageway 44 include sealable inflation passageways or one-way inflation valves, for example, as illustrated in U.S. Pat. No. 6,276,532, the content of which is incorporated herein by reference in its entirety.

As illustrated in another embodiment shown in FIG. 7, package 11 includes a thermoformed bottom chamber film 120 and a thermoformed bottom frame film 128, which may be provided as thermoformed base film 136. The thermoformed bottom chamber film 120 may provide a configuration adapted for convenient placement of, or conformance to, product 16 within chamber portion 12.

As illustrated in still another embodiment shown in FIG. 8, package 11 may include thermoformed bottom chamber film 120 and thermoformed bottom frame film 128, which may be provided as thermoformed base film 136, as well as a matching thermoformed top chamber film 118 and a thermoformed top frame film 126, which may be provided as thermoformed lid film 134.

When product 16 is packaged and stored under an atmosphere different from ambient air, package 10 (11) may conveniently include modified atmosphere 24 in chamber portion 12, so that product 16 may be packaged in modified atmosphere 24. A modified atmosphere may be useful, for example, to decrease the concentration of oxygen from that of ambient air or to increase the concentration of oxygen and carbon dioxide from that of ambient air in order to extend a packaged product's shelf-life or bloom color life. For example, when packaging meat, the atmosphere in the chamber portion 12 may comprise about 80% by volume oxygen and about 20% by volume carbon dioxide in order to inhibit the growth of harmful microorganisms and extend the time period in which the meat retains its attractive red ("bloom") coloration. As used herein, the term "modified atmosphere" is inclusive of a gas environment having a composition that is altered from that of ambient air for the purpose of extending the shelf life, enhancing the appearance, or reducing the degradation of a packaged product.

Examples of modified atmosphere 24 include gas environments having an oxygen concentration (by volume): 1) greater than about any of the following values: 30%, 40%, 50%, 60%, 70%, 80%, and 90%, 2) ranging between any of the preceding values (e.g., from about 30% to about 90%), 3) no more than about any of the following values: 15%, 10%, 5%, 1%, and 0%, and 4) ranging between any of the preceding values (e.g., from about 0% to about 15%). A modified atmosphere may also include gas environment having a carbon dioxide concentration of greater than about any of the following values: 10%, 20%, 30%, 40%, and 50% by volume. Modified atmosphere 24 may also include non-ambient amounts of one or more gases selected from e.g. argon, nitrogen, carbon monoxide, helium, and the like gases.

A modified atmosphere may include a volumetric quantity of one or more of $N_2$, $O_2$ and $CO_2$ in quantities that differ from the quantities of the same gases in the atmosphere at 20° C. and sea level (1 atmosphere of pressure). If a product is meat, poultry, fish, cheese, bakery or pasta, the following gas mixtures may be used (quantities are expressed in volume percentages at 20° C., 1 atm of pressure):

Red meats, Poultry skinless:

$O_2$=70%, $CO_2$=30%

Poultry with skin on, Cheese, Pasta, Bakery products:

$CO_2$=50%, $N_2$=50%

Fish $CO_2$=70%, $N_2$=30% or $CO_2$=40%, $N_2$=30%, $O_2$%=30

Processed meat $CO_2$=30%, $N_2$=70%

When modified atmosphere 24 is employed, a package as described herein may be useful for the packaging of oxygen-sensitive items (i.e., items that are perishable, degradable, or otherwise changeable in the presence of oxygen). Examples of oxygen-sensitive products or items include red meat (e.g., beef, veal, and lamb), processed meat, pork, poultry, fish, cheese, and vegetables. Package 10 (11) may also include an absorbent pad (not shown) within chamber portion 12, for example, to absorb meat purge and/or release moisture or fragrances.

When modified atmosphere 24 in chamber portion 12 is free from oxygen and the packaged product 16 is particularly oxygen-sensitive, it may also be advisable to include an oxygen scavenging agent in top and/or bottom chamber films 18 (118), 20 (120), in a layer in closer proximity to the packaged product than the gas-barrier layer. The oxygen scavenging agent present in the layer will react with the residual oxygen that is trapped in the package or that permeates into the package in spite of the gas barrier layer, thus maintaining the modified atmosphere 24 free from oxygen. The use of oxygen scavengers is described, for example, in U.S. Pat. No. 5,350,622, the content of which is incorporated herein by reference in its entirety, while a general method of triggering the oxygen scavenging process is described in U.S. Pat. No. 5,211,875, the content of which is incorporated herein by reference in its entirety.

Films may have any thickness suitable for the packaging application, taking into consideration factors such as whether films will be used for vacuum packaging, desired inflation pressure of frame and/or chamber portion, tensile strength of film material, hoop stress resulting from an inflated configuration of frame and/or chamber portion, the amount of abuse expected for the application, whether films are thermoformed or not, and the desired gas permeation rate through the films.

In an embodiment, the film is not heat-shrinkable. When, as in package 11 illustrated in FIGS. 7 and 8, one or both of the base and lid films are at least partially thermoformed, the thermoformable films may be substantially non oriented and their thickness, before the thermoforming step, may be 1.2 to 12 mils (30 to 300 μm), may be ≥2.5 mils (63.5 μm), or even ≥3 mils (76.2 μm).

In particular, when packaged product 16 is a food product, at least top chamber film 18 (118) may incorporate or have dispersed in effective amounts of one or more antifog agents in the film resin before forming the resin into a film, and in the case of a multilayer film, in one or more of the layers of the film. The antifog agent may also be applied as an antifog coating to at least one surface of the film. Useful antifog agents and their effective amounts are well known in the art.

Any of the films, for example, top chamber film 18 (118) and/or top frame film 26 (126), may be transparent to visible light to enable a consumer to see the packaged product in the areas where the film does not support a printed image (e.g., labeling information). As used herein, the term "transparent" is inclusive of material that transmits incident light with negligible scattering and little absorption, enabling objects (e.g., packaged product or print) to be seen clearly through the material under typical viewing conditions (i.e., the expected use conditions of the material). Also, any of the films may be opaque, colored, or pigmented. For example, bottom chamber film 20 (120) and/or bottom frame film 28 (128) may be opaque, colored, or pigmented to provide a background for the packaged product 16 or to simulate the appearance of a conventional meat tray, or to hide the presence of an absorbing pad or of drip.

Films may also include optical properties comprising: haze 1% to 20%, 5-15% (ASTM D1003) and gloss at 60° 90 g.u. to 150 g.u., 100-130 g.u. (ASTM D2457).

Another class of thermoplastic structures that proved useful for the manufacture of a package, e.g., the manufacture of a package as illustrated in FIG. 7 and in FIG. 8 wherein one or both of the base and lid films are thermoformed (or at least partially thermoformed), may comprise laminates with an outer heat-seal layer comprising an ethylene homo- or copolymer (e.g. LLDPE, VLDPE, homogeneous ethylene-α-olefin copolymers, LDPE, EVA, ionomers, etc.), a gas-barrier layer comprising EVOH, and the other outer abuse resistant layer, comprising a polyamide, and even a polyamide with a melting point equal to or higher than 175° C. The thickness of this laminate, which can be obtained by heat- or glue-lamination of pre-formed layers or by coextrusion or extrusion coating, may be 1 to 11.8 mils (25 to 300 μm), 2.5 to 9 mils (63.5 to 228.6 μm), or even 3 to 8 mils (76.2 to 203.2 μm). The structure typically comprises one or more inner bulk layers to reach the desired thickness, typically of low cost polyolefins, e.g. polyethylene and/or polypropylene resins. Tie layers, to improve the bond between the various layers and avoid delamination, might also be present, if needed or appropriate.

In an embodiment, an agent may be enclosed within a chamber of frame 14 illustrated in FIGS. 6-8, such that the agent does not leak out of the frame unless the agent is released into chamber portion 12 by rupturing frangible closure zone 22 and frangible frame inner closure zone 30.

An embodiment of a method of releasing the agent into chamber portion 12 of package 10 illustrated in FIGS. 6-8 comprises providing the agent in hollow frame 14 adjacent to chamber portion 12; and rupturing a frangible closure (e.g. frangible chamber closure zone 22 and frangible frame inner closure zone 30) between chamber portion and hollow frame to release the agent into chamber portion. Furthermore, a product 16, e.g., a piece of meat, may be included in chamber portion when releasing the agent into the chamber portion.

Figure 10:
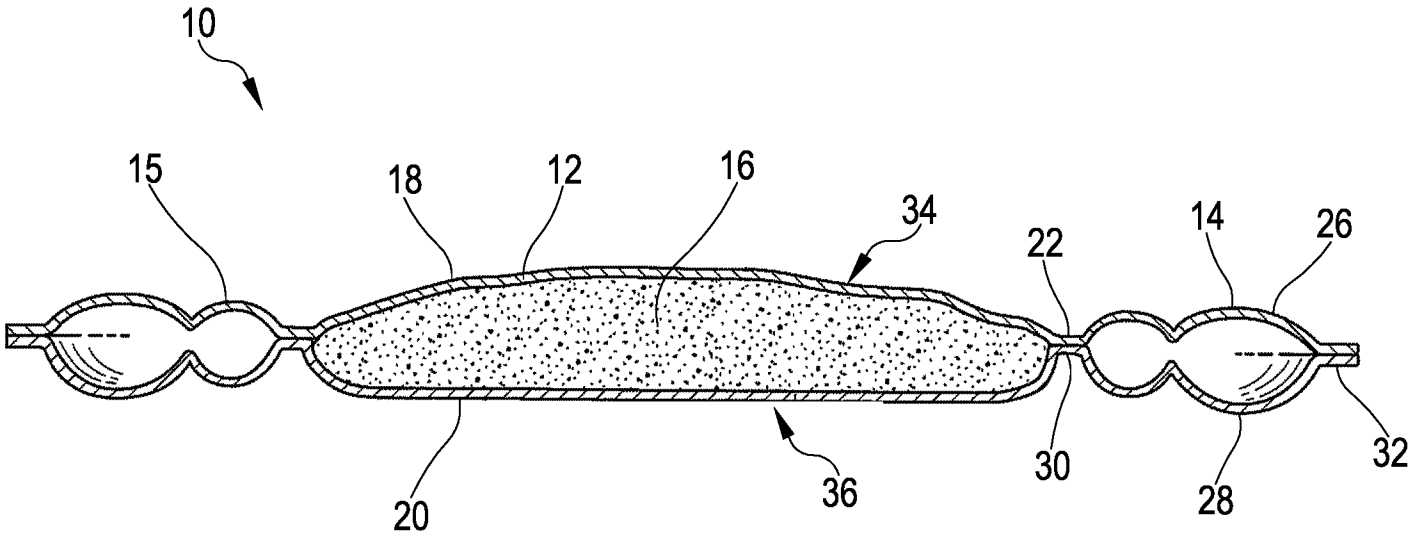
FIG. 10 is a sectional view of the package in FIG. 9 taken along 10-10 of FIG. 9.

FIGS. 9 and 10 illustrate an embodiment of a package 10, as follows. FIG. 10 is a cross-section of FIG. 9 taken along 10-10. Package 10 includes top and bottom opposing chamber films 18 and 20 fixed together in frangible chamber closure zone 22 to define chamber portion 12 that contains product 16. Package 10 also includes hollow frame 14 adjacent to chamber portion 12, and frame contains an agent, e.g. chlorine dioxide. Frangible chamber closure zone 22 is between chamber portion 12 and frame 14, and rupturing frangible chamber closure zone 22 allows agent to flow from frame 14 to chamber portion 12 and contact product 16. Frangible chamber closure zone 22 may have a release strength of 0.058 to 0.309 N/mm. Lid film 34 extends continuously from the frame 14 to the chamber portion 12, thereby including both top chamber film 18 and top frame film 26; and base film 36 extends continuously from the frame 14 to the chamber portion 12, thereby including both bottom chamber film 20 and bottom frame film 28. Frame also comprises top and bottom opposing frame films 26 and 28 fixed together at frame outer closure zone 32 proximate outer side of the frame. Frame further comprises frangible frame inner closure zone 30 proximate chamber portion 12, frangible frame inner closure zone 30 is coextensive with frangible chamber closure zone 22, and frangible frame inner closure zone may have a release strength of 0.058 to 0.309 N/mm. Frame 14 also includes a rupturable agent director 15 formed adjacent to the frangible chamber closure zone 22. Rupturable agent director 15 is spherical and configured to direct the agent toward the product 16, e.g. meat, upon rupturing the frangible chamber closure zone 22. Frangible chamber closure zone 22 forms a boundary between agent director 15 and chamber portion 12. In the embodiment that is illustrated in FIGS. 9 and 10, a vacuum has been applied between top chamber film 18 and bottom chamber film 20, and package 10 is in a vacuum skin configuration. Chamber portion 12 contains product 16 and the top and bottom chamber films 18 and 20 are collapsed together under vacuum around product.

Agent director may have a conical, hemispherical, spherical, etc. shape.

The term "vacuum skin packaging" (hereinafter "VSP") as used herein is inclusive of a product that is packaged under vacuum, such that gases have been evacuated from the space containing the product. A top skin film formed around the product may include a barrier to oxygen, air, and other gases detrimental to the shelf or storage life of a product, e.g. food. Films used for VSP may include a high degree of formability/stretchability in order to avoid wrinkles and other irregularities in the final packaged product.

An embodiment of a method of releasing the agent into chamber portion 12 of package 10 illustrated in FIGS. 9 and 10 comprises providing the agent in hollow frame 14 adjacent to chamber portion 12; and rupturing a frangible closure (e.g. frangible chamber closure zone 22 and frangible frame inner closure zone 30) between chamber portion and hollow frame to release the agent into chamber portion. The frangible closure may be ruptured by squeezing frame and/or agent director 15. Furthermore, a product 16, e.g., meat, may be included in chamber portion when releasing the agent into the chamber portion.

Table I lists layers of an embodiment of a lid film. Layer designation 1 represents a seal layer, layers 2-7 are intermediate layers, and layer 8 is an external layer. The layers are arranged in a stack from seal layer 1 through external layer 8, in numerical order.

TABLE I

| Layer Designation | Layer Function | Layer Chemical Identity | Layer Thickness |
|---|---|---|---|
| 1 | Seal layer | 100% LDPE #1 | 0.51 mils (13 μm) |
| 2 | Tie Layer | 100% EVA #1 | 0.31 mils (7.9 μm) |
| 3 | Intermediate Layer | 100% EVA #2 | 1.50 mils (38.1 μm) |
| 4 | Tie Layer | 100% LLDMPE | 0.12 mils (3.0 μm) |
| 5 | Intermediate Layer | 100% EVOH #1 | 0.31 mils (7.9 μm) |
| 6 | Tie Layer | 100% LLDMPE | 0.12 mils (3.0 μm) |
| 7 | Intermediate Layer | 100% EVA #2 | 2.32 mils (58.9 μm) |
| 8 | External Layer | 100% HDPE #1 | 0.71 mils (18 μm) |

The total thickness of lid film in Table I is 5.9 mils (149.8 μm). LDPE This LD259™ low density polyethylene homopolymer, obtained from Exxon Mobil Corp., having a melt flow rate of 12 g/10 min and a density of 0.915 g/cm$^3$. EVA #1 is ELVAX 3170™ ethylene/vinyl acetate copolymer, obtained from E. I. du Pont de Nemours and Company, having a melt flow rate of 2.5 g/10 min and a density of 0.94 g/cm$^3$. EVA #2 is ESCORENE ULTRA FL00119™ ethylene/vinyl acetate copolymer, obtained from Exxon Mobil Corp., having a melt flow rate of 0.65 g/10 min and a density of 0.942 g/cm$^3$. LLDMPE is OREVAC GREF PE 18300 NB SA PE 25™ linear low density polyethylene, maleic anhydride-modified, obtained from Arkema S.A., having a melt flow rate of 2.3 g/10 min and a density of 0.916 g/cm$^3$. EVOH #1 is EVAL F101B™ hydrolyzed ethylene/vinyl acetate copolymer, obtained from EVALCA/Kuraray, having a melt flow rate of 1.6 g/10 min and a density of 1.196 g/cm$^3$. HDPE #1 is RIGIDEX HD6070FA™ high density polyethylene, obtained from Ineos Group Limited, having a melt flow rate of 7.6 g/10 min and a density of 0.960 g/cm$^3$.

Table II lists layers of an embodiment of a base film. Layer designation 1 represents a seal layer, layers 2-5 are intermediate layers, and layer 6 is an external layer. The layers are arranged in a stack from seal layer 1 through external layer 6, in numerical order.

TABLE II

| Layer Designation | Layer Function | Layer Chemical Identity | Layer Thickness |
|---|---|---|---|
| 1 | Seal layer | 100% EVA #3 | 0.08 mils (2.0 μm) |
| 2 | Intermediate Layer | 100% BLEND | 0.24 mils (6.1 μm) |
| 3 | Intermediate Layer | 100% EVA #4 | 1.02 mils (25.9 μm) |
| 4 | Intermediate Layer | 100% PETG #1 | 0.55 mils (14 μm) |
| 5 | Intermediate Layer | 100% PET #1 | 5.59 mils (142 μm) |
| 6 | External Layer | 100% PETG #1 | 0.39 mils (9.9 μm) |

The total thickness of base film in Table II is 7.87 mils (199.9 μm). EVA #3 is ESCORENE ULTRA FL00909™ ethylene/vinyl acetate copolymer, obtained from Exxon Mobil Corp., having a melt flow rate of 9 g/10 min and a density of 0.9280 g/cm$^3$. BLEND is a resin blend comprising: 30% Polybutene-1 0300M™ polybutylene, obtained from LyondellBasell Industries, having a melt flow rate of 4 g/10 min and a density of 0.915 g/cm$^3$; 19% ELVALOY 741™ ethylene/vinyl acetate/carbon monoxide copolymer, obtained from DuPont, having a density of 1 g/cm$^3$; and 51% Surlyn 1601™ sodium neutralized ethylene methacrylic acid copolymer, obtained from DuPont, having a melt flow rate of 1.30 g/10 min and a density of 0.9400 g/cm$^3$. EVA #4 is ESCORENE FL 00226™ ethylene/vinyl acetate copolymer, obtained from Exxon Mobil Corp., having a melt flow rate of 2.00 g/10 min and a density of 0.9480 g/cm$^3$. PETG #1 is GN001™ polyethylene terephthalate glycol-modified, obtained from Eastman Chemical, having a density of 1.27 g/cm$^3$. PET #1 is Petalo RPET 400™ polyethylene terephthalate, obtained from DENTIS srl, having a density of 1.35 g/cm$^3$.

Seal layers of the lid film and the base film listed in Tables I and II may be fixed together to form a package.

The lid film and the base film listed in Tables I and II may be used to manufacture a package in a vacuum skin configuration.

Referring again to the embodiment illustrated in FIG. 3, package 10 includes discrete frame cells 21, 25, and 31. However, package may be modified to include only one cell on one side of package 10, two cells on opposite sides of package 10, two cells on adjacent sides of package 10, three cells on package 10, etc. Frame 14 may be formed partially around chamber portion 12. Furthermore, an agent director may be included on one or more of the cells. Cells may be used as handles.

Figure 11:
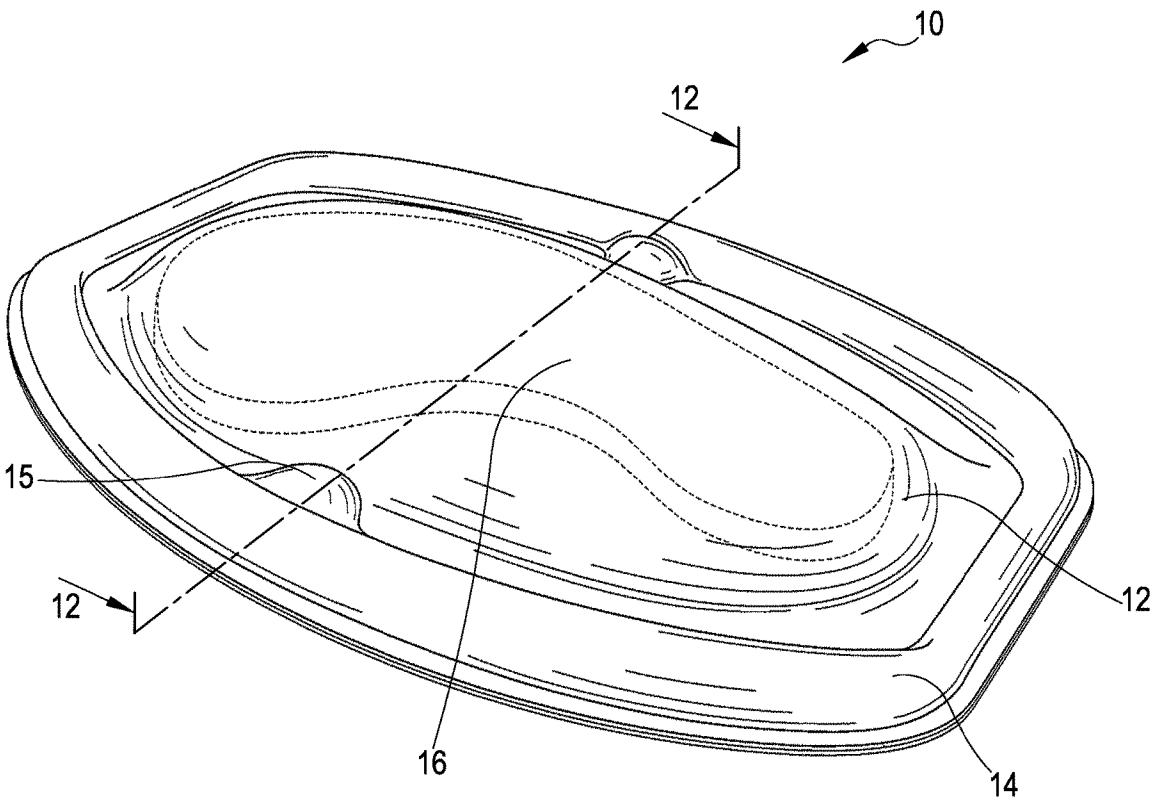
FIG. 11 is a perspective view of an embodiment of a package.
Figure 12:
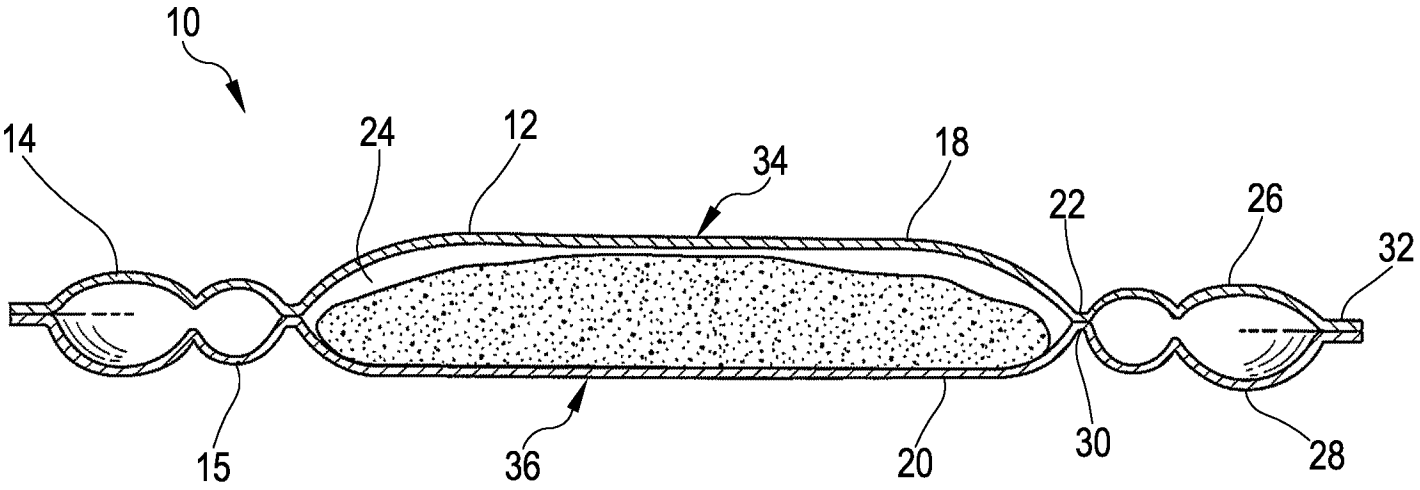
FIG. 12 is a sectional view of the package in FIG. 11 taken along 12-12 of FIG. 11.

FIGS. 11 and 12 illustrate an embodiment of a package 10, as follows. FIG. 12 is a cross-section of FIG. 11 taken along 12-12. Package 10 includes top and bottom opposing chamber films 18 and 20 fixed together in frangible chamber closure zone 22 to define chamber portion 12 that contains product 16. Package 10 also includes hollow frame 14 adjacent to chamber portion 12, and frame contains an agent, e.g. aroma molecules. Frangible chamber closure zone 22 is between chamber portion 12 and frame 14, and rupturing frangible chamber closure zone 22 allows agent to flow from frame 14 to chamber portion 12 and contact product 16. Frangible chamber closure zone 22 may have a release strength of 0.058 to 0.309 N/mm. Frame also comprises top and bottom opposing frame films 26 and 28 fixed together at frame outer closure zone 32 proximate outer side of the frame. Frame further comprises frangible frame inner closure zone 30 proximate chamber portion 12, frangible frame inner closure zone 30 is coextensive with frangible chamber closure zone 22, and frangible frame inner closure zone may have a release strength of 0.058 to 0.309 N/mm. Lid film 34 extends continuously from the frame 14 to the chamber portion 12, thereby including both top chamber film 18 and top frame film 26; and base film 36 extends continuously from the frame 14 to the chamber portion 12, thereby including both bottom chamber film 20 and bottom frame film 28. Frame 14 also includes a rupturable agent director 15 formed adjacent to the frangible chamber closure zone 22. Rupturable agent director 15 is spherical and configured to direct the agent toward the product 16, e.g. meat, upon rupturing the frangible chamber closure zone 22. Frangible chamber closure zone 22 forms a boundary between agent director 15 and chamber portion 12. In the embodiment that is illustrated in FIGS. 11 and 12, a modified atmosphere 24 has been included around product 16 between top chamber film 18 and bottom chamber film 20 in chamber portion 12.

Figure 13:
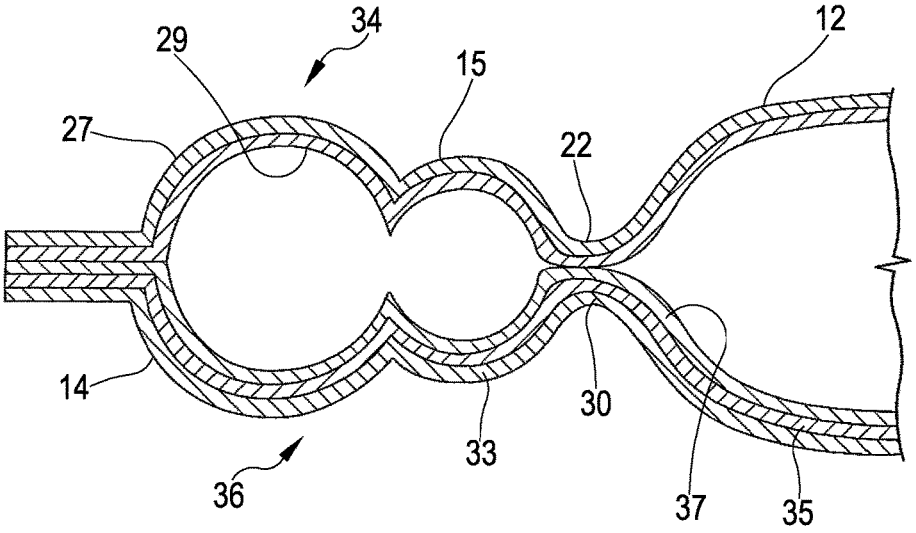
FIG. 13 is an enlarged view of an edge of the package in FIG. 12.

FIG. 13 is an enlarged view of an edge of the package in FIG. 12. In FIG. 13, lid film 34 includes an outer layer 27 and seal layer 29; and base film 36 includes outer layer 33, an intermediate frangible layer 35, and a seal layer 37. Frangible layer 35 comprises a frangible blend having a release strength of 0.058 to 0.309 N/mm. Seal layer 29 of lid film 34 is fixed to seal layer 37 of base film 36 within frangible chamber zone 22.

Figure 14:
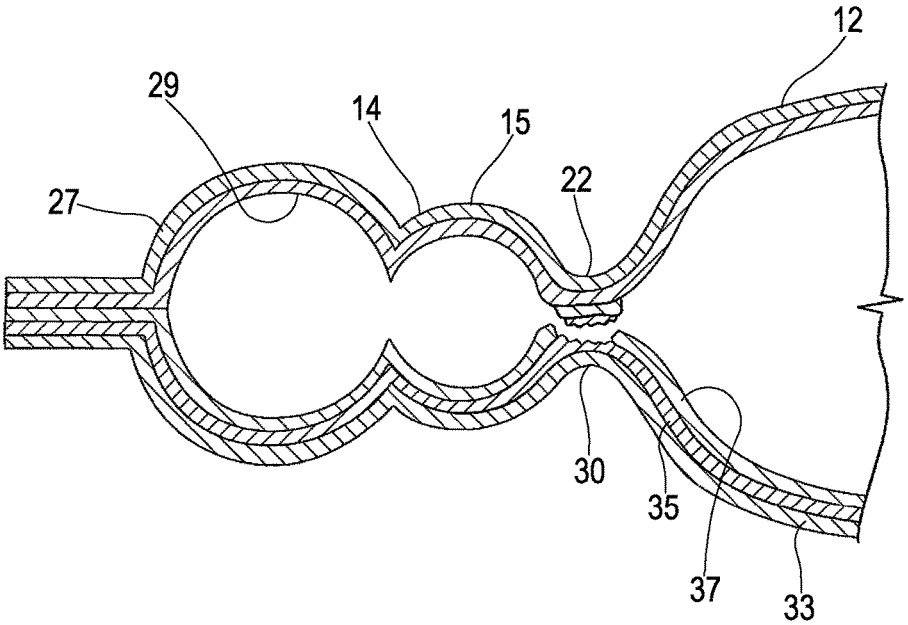
FIG. 14 is an enlarged view of an edge of the package in FIG. 11 in a ruptured configuration.

FIG. 14 illustrates the embodiment of package 10 that is illustrated in FIG. 13, after rupture of frangible chamber closure zone 22 and frangible frame inner closure zone 30. Pressure applied to frame 14 and/or agent director 15 caused frangible layer 35 to cohesively separate and seal layer 37 to tear. Upon rupture of frangible chamber closure zone 22 and frangible frame inner closure zone 30 in this embodiment, agent may pass from frame 14 to chamber portion 12.

Figure 15:
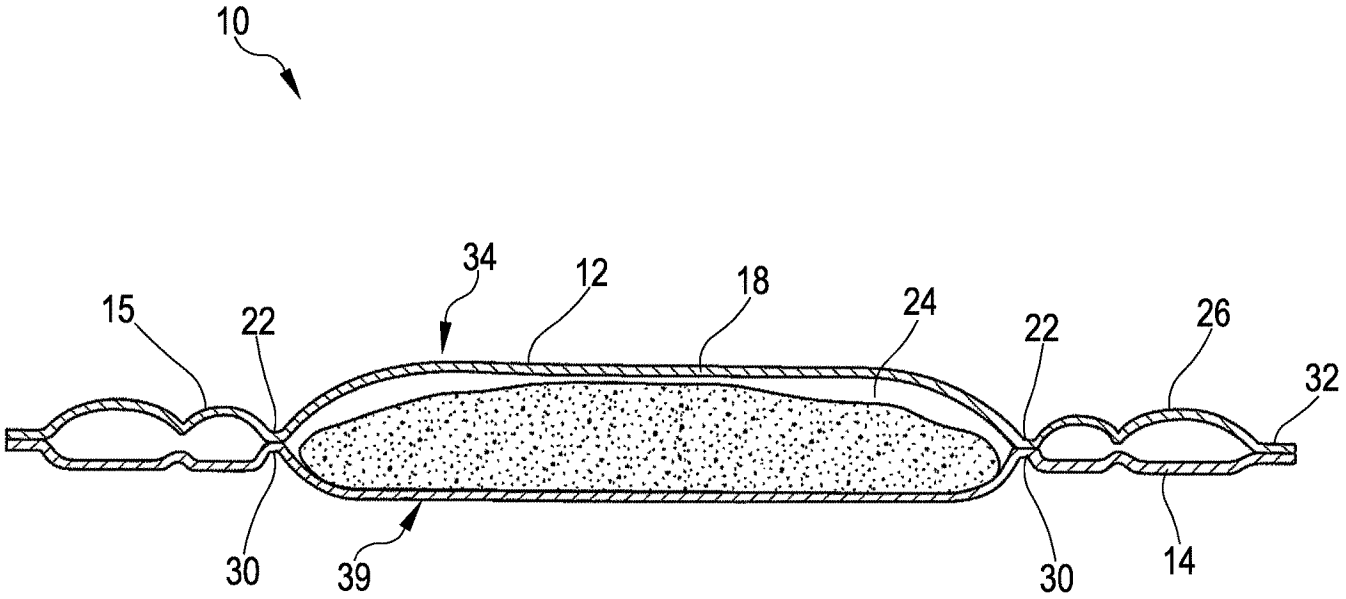
FIG. 15 is a sectional view of an embodiment of a package.

FIG. 15 illustrates an embodiment of a package 10 including a preformed base member 39, as follows. Package 10 includes top chamber film 18 fixed to base member 39 in frangible chamber closure zone 22 to define chamber portion 12 that contains product 16. Package 10 also includes hollow frame 14 adjacent to chamber portion 12, and frame contains an agent, e.g. seasoning. Frangible chamber closure zone 22 is between chamber portion 12 and frame 14, and rupturing frangible chamber closure zone 22 allows agent to flow from frame 14 to chamber portion 12 and contact product 16. Frangible chamber closure zone 22 may have a release strength of 0.058 to 0.309 N/mm. Frame comprises top frame film 26 fixed to base member 39 at an frame outer closure zone 32 proximate outer side of the frame. Frame further comprises frangible frame inner closure zone 30 proximate chamber portion 12. Frangible frame inner closure zone 30 is coextensive with frangible chamber closure zone 22, and frangible frame inner closure zone has a release strength of 0.058 to 0.309 N/mm. Lid film 34 extends continuously from the frame 14 to the chamber portion 12, thereby including both top chamber film 18 and top frame film 26. Frame 14 also includes a rupturable agent director 15 formed adjacent to the frangible chamber closure zone 22. Rupturable agent director 15 is spherical and configured to direct the agent toward the product 16, e.g. meat, upon rupturing the frangible chamber closure zone 22. Frangible chamber closure zone 22 forms a boundary between agent director 15 and chamber portion 12. In the embodiment that is illustrated in FIG. 15, modified atmosphere 24 has been included around product 16 between lid film 34 and base member 39 in chamber portion 12.

An embodiment of a method of releasing the agent into chamber portion 12 of package 10 illustrated in FIG. 15 comprises providing the agent in hollow frame 14 adjacent to chamber portion 12; and rupturing a frangible closure (e.g. frangible chamber closure zone 22 and frangible frame inner closure zone 30) between chamber portion and hollow frame to release the agent into chamber portion. The frangible closure may be ruptured by squeezing frame 14 and/or agent director 15. Furthermore, a product 16, e.g., a piece of meat, may be included in chamber portion when releasing the agent into the chamber portion.

A base member may be made of a single layer or a multi-layer polymeric material. In case of a single layer material, suitable polymers may be polystyrene, polypropylene, polyesters, high density polyethylene, poly(lactic acid), PVC, etc., in either foamed or solid configuration. A base member may also be made of paper-based materials, such as cardboard.

A base member may be provided with gas barrier properties, including an oxygen transmission rate of less than 200 $cm^3/m^2$-day-bar, less than 150 $cm^3/m^2$-day-bar, or less than 100 $cm^3/m^2$-day-bar as measured according to ASTM D3985 at 23° C. and 0% relative humidity. Materials for a gas barrier monolayer thermoplastic base member may be polyesters, polyamides and the like.

If a multi-layer material is used for forming the base member, suitable polymers may be ethylene homo- and co-polymers, propylene homo- and copolymers, polyamides, polystyrene, polyesters, poly(lactic acid), PVC, PVdC, EVOH, etc. Part of the multi-layer material may be solid and part may be foamed.

For example, the base member may comprise at least one layer of a foamed polymeric material chosen from the group consisting of polystyrene, polypropylene, polyesters, etc. If base member is constructed of foamed materials, base member may also be covered with a barrier layer, in order to contain, prevent leakage, of an agent within portion of base member forming part of hollow frame.

A multi-layer material may be produced either by co-extrusion of all the layers using co-extrusion techniques or by glue- or heat-lamination of, for instance, a rigid, foamed or solid, base member with a thin film.

The thin film may be laminated either on the side of the base member in contact with a product or on the side facing away from the product or on both sides. In the latter case the films laminated on the two sides of the base member may be the same or different. A layer of an oxygen barrier material, for instance (ethylene-co-vinyl alcohol) copolymer, may be present to increase the shelf-life of the packaged product.

Gas barrier polymers that may be employed for the gas barrier layer are PVDC, EVOH, polyamides, polyesters and blends thereof. The thickness of the gas barrier layer may be set in order to provide the base member with an oxygen transmission rate suitable for the specific packaged product.

The base member may also comprise a heat sealable layer. Generally, a heat-sealable layer may be selected from polyolefins, such as ethylene homo- or co-polymers, propylene homo- or co-polymers, ethylene/vinyl acetate copolymers, ionomers, and the homo- and co-polyesters, e.g. PETG, a glycol-modified polyethylene terephthalate.

An adhesive layer, to better adhere the gas-barrier layer to the adjacent layers, may be present in the gas barrier material for the base member and are preferably present depending in particular on the specific resins used for the gas barrier layer.

A frangible layer may also be included in the base member as a seal layer or a layer adhered to a seal layer.

In case of a multilayer material used to form a base member, part of a structure may be foamed and part may be un-foamed. Base member may comprise (from the outermost layer to the innermost food-contact layer) one or more structural layers, a material such as foam polystyrene, foam polyester or foam polypropylene, or a cast sheet of e.g. polypropylene, polystyrene, poly(vinyl chloride), polyester or cardboard; a gas barrier layer and a heat-sealable layer.

A base member may be obtained from a sheet of foamed polymeric material having a film comprising at least one oxygen barrier layer and at least one surface sealing layer laminated onto the side facing the packaged product, so that the surface sealing layer of the film is the food contact layer the base member. A second film, either barrier or non-barrier, may be laminated on the outer surface of base member.

Materials of a base member, suitable for a package and containing foamed parts, may have a total thickness of less than 8 mm, between 0.5 mm and 7.0 mm, or between 1.0 mm and 6.0 mm.

Materials of a base member, suitable for a package and not containing foamed parts, may have a total thickness of the single-layer or multi-layer thermoplastic material of less than 2 mm, between 0.1 mm and 1.2 mm, between 0.2 mm and 1.0 mm, and even less than 0.3 mm (300 μm).

Figure 16:
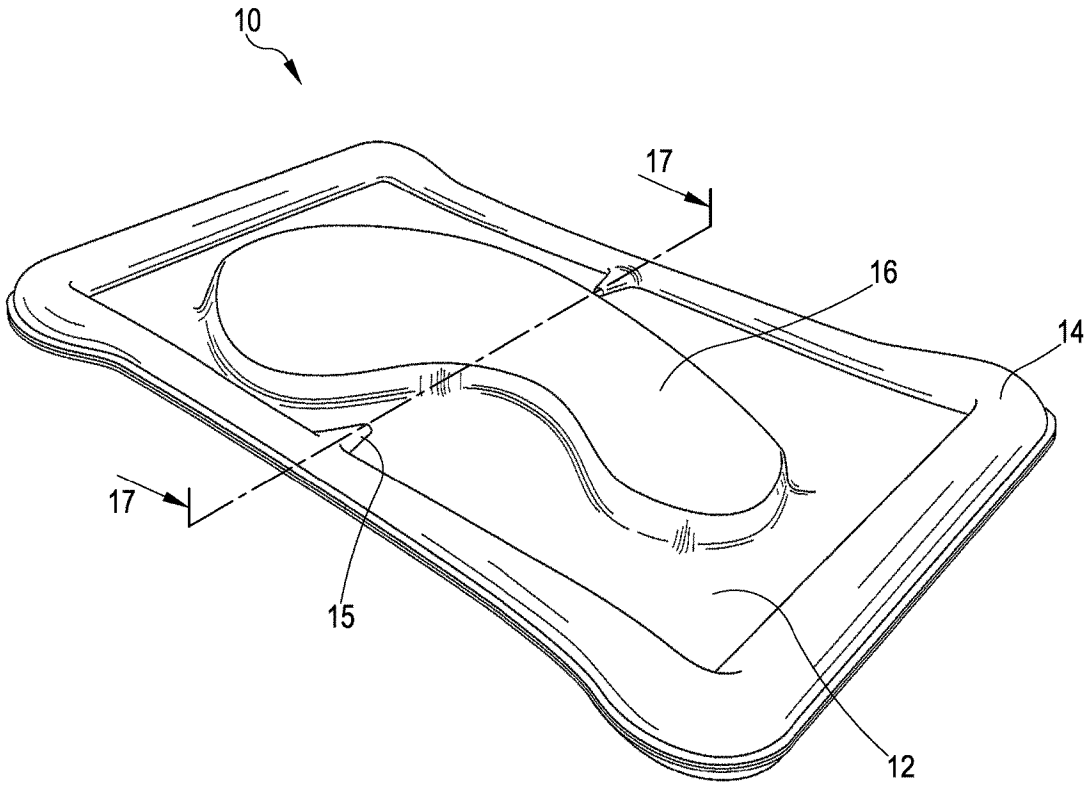
FIG. 16 is a perspective view of an embodiment of a package.
Figure 17:
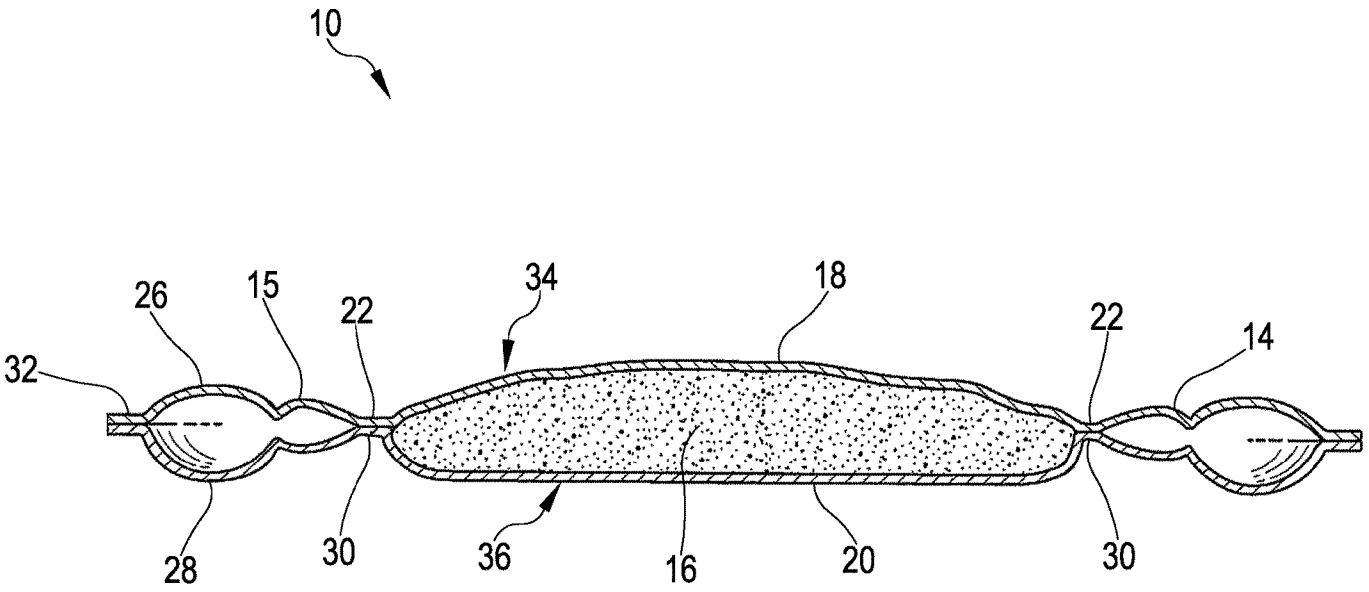
FIG. 17 is a sectional view of the package in FIG. 16 taken along 17-17 of FIG. 16.

FIGS. 16 and 17 illustrate an embodiment of a package 10, as follows. FIG. 17 is a cross-section of FIG. 16 taken along 17-17. Package 10 includes top and bottom opposing chamber films 18 and 20 fixed together in frangible chamber closure zone 22 to define chamber portion 12 that contains product 16. Package 10 also includes hollow frame 14 adjacent to chamber portion 12, and frame contains an agent, e.g. biocide. Frangible chamber closure zone 22 is between chamber portion 12 and frame 14, and rupturing frangible chamber closure zone 22 allows agent to flow from frame 14 to chamber portion 12 and contact product 16. Frangible chamber closure zone 22 may have a release strength of 0.058 to 0.309 N/mm. Frame also comprises top and bottom opposing frame films 26 and 28 fixed together at frame outer closure zone 32 proximate outer side of the frame. Frame further comprises frangible frame inner closure zone 30 proximate chamber portion 12, frangible frame inner closure zone 30 is coextensive with frangible chamber closure zone 22, and frangible frame inner closure zone may have a release strength of 0.058 to 0.309 N/mm. Lid film 34 extends continuously from the frame 14 to the chamber portion 12, thereby including both top chamber film 18 and top frame film 26; and base film 36 extends continuously from the frame 14 to the chamber portion 12, thereby including both bottom chamber film 20 and bottom frame film 28. Frame 14 also includes a rupturable agent director 15 formed adjacent to the frangible chamber closure zone 22. Rupturable agent director 15 is conical and configured to direct the agent toward the product 16, e.g. meat, upon rupturing the frangible chamber closure zone 22. Frangible chamber closure zone 22 forms a boundary between agent director 15 and chamber portion 12. In the embodiment that is illustrated in FIGS. 16 and 17, a vacuum is applied between top chamber film 18 and bottom chamber film 20, and package 10 is in a VSP configuration. Chamber portion 12 contains product 16 and the top and bottom chamber films 18 and 20 are collapsed together under vacuum around product.

An embodiment of a method of releasing the agent into chamber portion 12 of package 10 illustrated in FIGS. 16 and 17 comprises providing the agent in hollow frame 14 adjacent to chamber portion 12; and rupturing a frangible closure (e.g. frangible chamber closure zone 22 and frangible frame inner closure zone 30) between chamber portion and hollow frame to release the agent into chamber portion. The frangible closure may be ruptured by squeezing frame and/or agent director 15. Furthermore, a product 16, e.g., meat, may be included in chamber portion when releasing the agent into the chamber portion.

Figure 32:
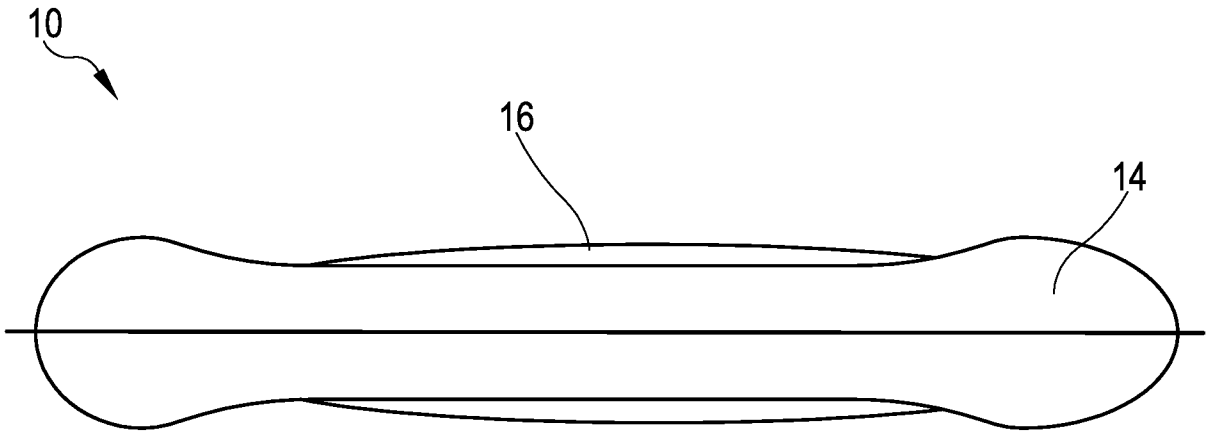
FIG. 32 is a side elevational view of a product in an embodiment of a package.

FIG. 32 illustrates product 16 in an embodiment of package 10, as follows. The frame 14 of package is thicker than the thickness of the product 16.

In an embodiment, package 10 may be formed using packaging machine 74 (FIG. 5). Packaging machine 74 includes base unwind mandril 45 that supports base film roll 46 so that base web 40 may be fed to vacuum/gas-flush/heat closure/inflation chamber 48 (i.e., "heat closure chamber 48"). Lid unwind mandril 51 supports lid web roll 50 so that lid web 38 may also be fed to heat closure chamber 48.

FIGS. 18-22 illustrate an embodiment of heat closure chamber 48 including top chamber casing 52 and opposing bottom chamber casing 54 for use in producing a package including a modified atmosphere in chamber portion 12. FIG. 23 illustrates an embodiment of a heat closure chamber 48 for use in producing a vacuum skin package.

The top and bottom chamber casings are moveable relative each other to a chamber open mode, as illustrated in FIGS. 18 and 22, and a chamber closed mode, illustrated in FIGS. 19-21. In the chamber open mode, the top and bottom casings 52 and 54 are spaced apart to allow the lid and base webs 38, 40 and product 16 to enter heat closure chamber 48. In the chamber closed mode, top and bottom casings 52, 54 are proximate each other to form an enclosed chamber volume 68.

Top chamber casing 52 may enclose and slideably receive both inner heating bar 56 and outer heating bar 58. Bottom chamber casing 54 may support anvil 60, which opposes both the inner and outer heating bars. Inner heating bar 56 and anvil 60 are moveable relative each other between an inner heating bar engaged position and an inner heating bar disengaged position. In the inner heating bar engaged position, illustrated in FIGS. 20 and 21, inner heating bar 56 and anvil 60 are proximate each other to define inner chamber volume 70 and outer chamber volume 72. In the inner heating bar disengaged position, illustrated in FIG. 19, the inner heating bar 56 and anvil 60 are spaced apart.

In FIG. 23, heat closure chamber 48 for use in producing a vacuum skin package includes heating bar 56 having a different shape and the additional function of heating and pre-stretching by contact with lid web to create a dome shape. In VSP, the packaging material may comprise a base web 40 and a lid web 38. The item to be packaged may be first placed onto the base web, which may be flexible, rigid or semi-rigid, flat or tray-shaped, and may also comprise one or more layers of foamed thermoplastic materials as herein described. Then the lid web 38, which may be pre-heated, and the base web 40 supporting the item to be packaged, may be separately fed to the packaging station where the top film may be further heated by contact with the inner surface of a dome which may then lowered over the supported item. The dome formed by heating bar 56 may be heated 170-230° C., or even 200° C. The space between the lid web 38 and base web 40 may be evacuated using a vacuum source 62 and nozzle 63, and lid web 40 may be allowed to come into contact with the base web 40 and with the item to be packaged. The heat closure chamber 48 in FIG. 23 includes a space for insertion of nozzle 63. Lid web 38 may be held against the dome inner surface for instance by vacuum pressure and then released when it is desired to allow the lid web, sufficiently heated, to drape over the product. Fixing of the lid and base webs together may be achieved by a combination of heat from the dome and pressure difference between the inside of the package and the outside atmosphere and may be aided by mechanical pressure and/or extra-heating. The area that is to form chamber portion may be evacuated just prior to fixing lid web to base web at frangible chamber closure zone, in order to form vacuum in chamber portion. The shape/dimensioning of such dome may be predetermined based on a product to be packaged. Heating bar 56 in FIG. 23 may be provided with suction and air channels to 1) apply vacuum in order to adhere the lid web 38 to heating bar 56 and 2) to subsequently supply air to collapse the lid web onto the base web and the product to be packaged.

Outer heating bar 58 and anvil 60 are moveable relative each other between an outer heating bar engaged position and an outer heating bar disengaged position. In the outer heating bar engaged position, illustrated in FIG. 21, outer heating bar 58 and anvil 60 are proximate each other. In the outer heating bar disengaged position, illustrated in FIGS. 19 and 20, the outer heating bar 58 and anvil 60 are spaced apart.

Heat closure chamber 48 includes a vacuum source 62, a modified atmosphere source 64, and an inflation gas and agent supply source 66, each of which is capable of controlled fluid communication with heat closure chamber 48, as discussed further below.

Cutter 76 is downstream from the heat closure chamber 48. Suitable cutters are well known in the art and may include, for example, rotary cutters, knife cutters, cutting blades, and laser cutters.

In the operation of packaging machine 74, base web 40 is unwound from base web roll 46 supported by base unwind mandril 45 and is fed to heat closure chamber 48. Base web 40 may be pulled along by gripping chains (not shown) at two sides, as is known in the art. Product 16 may be placed on base web 40 before the web is fed to heat closure chamber 48. Lid web 38 is unwound from lid web roll 50 supported by lid unwind mandril 51 and is also fed to heat closure chamber 48. Lid web 38 may also be pulled along by gripping chains (not shown) at two sides, as is known in the art. At least a portion of lid web 38 may be positioned over product 16, either before or after product 16 enters heat closure chamber 48.

The lid and base webs 38, 40 on either side of product 16 are positioned between the top chamber casing 52 and bottom chamber casing 54 while the heat closure chamber 48 is in the chamber open mode (FIG. 18). Next, the heat closure chamber 48 moves to a chamber closed mode so that top and bottom chamber casings 52, 54 engage, compress, or squeeze the lid and base webs 38, 40 between them and as a result form three essentially airtight enclosed chamber volumes: upper chamber volume 68 (which is a volume above web 38), lower chamber volume 69 (which is a volume below web 40), and intermediate chamber volume 67 (which is a volume between webs 38 and 40 enclosing product 16 (FIG. 19)). Optionally, upper and lower chamber volumes 68, 69 may be placed in fluid communication by appropriate piping, tubing, or other means, as is known in the art.

In the chamber closed mode (FIG. 19), a vacuum may be pulled on the enclosed intermediate chamber volume 67 to evacuate a desired amount of enclosed ambient air through vacuum source 62. Next, a modified atmosphere of a desired composition and amount may be introduced into intermediate chamber volume 67 through modified atmosphere source 64. The modified atmosphere may be introduced at a temperature lower than the ambient temperature, so that upon later warming to ambient temperature, the modified atmosphere within chamber portion 12 may obtain an above-ambient pressure.

It may be desirable to maintain a balanced force on the upper and lower webs (i.e., avoid ballooning of the intermediate chamber volume 67) when introducing modified atmosphere into intermediate chamber volume 67. To do so, the pressure in the upper and lower chamber volumes 68, 69 may be increased by introducing a gas (e.g., air or modified atmosphere) into those chamber volumes when introducing modified atmosphere into intermediate chamber volume 67.

Subsequently, inner heating bar 56 and anvil 60 move to the inner heating bar engaged position (FIG. 20) to compress lid and base webs 38, 40 between them and also to define inner chamber volume 70, outer chamber volume 72, and frame volume 73 (between the lid and base webs). The inner heating bar is heated to a temperature effective to fix the webs together in frangible chamber closure zone 22 (see, e.g., FIG. 2). In so doing, chamber portion 12 is formed enclosing modified atmosphere 24 and product 16 (see, e.g., FIG. 2).

A structure of inner heating bar 56 and/or anvil 60 may shaped to form agent director 15 on frame 14 of package 10 (see, e.g., FIGS. 9-17) when inner heating bar 56 and anvil 60 are brought together.

Furthermore, an amount of heat applied by inner heating bar 56 may be increased or decreased to provide the desired amount of release strength for frangible chamber closure zone.

Next, an inflation gas is introduced into the frame volume 73 through inflation gas and agent supply source 66. Suitable inflation gas includes, for example, air, nitrogen, or modified atmosphere (including modified atmosphere having the same composition as that introduced through modified atmosphere source 64, as discussed above). An agent may also be introduced in frame 14 through gas inflation gas and agent supply source 66. An amount of inflation gas is added to elevate the pressure within frame volume 73 to a desired amount, for example, a gauge pressure (wherein "gauge pressure" is the pressure difference between the system and the atmospheric pressure) of at least about any of the following values: 0.1, 0.2, 0.3, 0.4, 0.5, 0.6, 0.8, and 1 bar; a gauge pressure of less than about 2 bar; and a gauge pressure ranging between any of the foregoing values (e.g., from about 0.2 bar to about 0.8 bar, and from about 0.3 bar to about 2 bar).

It may also be desirable to maintain a balanced force on the upper and lower webs (i.e., avoid premature ballooning of the frame volume 73) when introducing inflation gas into frame volume 73. To do so, the pressure in the outer chamber volume 72 may be increased by introducing an inflation gas into that chamber volume when introducing inflation gas into frame volume 73.

Turning to FIG. 21, outer heating bar 58 and anvil 60 move to the outer heating bar engaged position (FIG. 21) to compress lid and base webs 38, 40 between them. The outer heating bar is heated to a temperature effective to fix the webs together in frame outer closure zone 32 (see, e.g., FIG.

2). In so doing, hollow frame 14 is formed enclosing the inflation gas at the elevated pressure.

Next, the inner and outer chamber volumes 70, 72 and lower chamber volume 69 may be vented to restore ambient pressure before opening the chamber. Then, the top and bottom chamber casings return to the chamber open mode, with inner heating bar 56 and anvil 60 in the disengaged position and outer heating bar 58 and anvil 60 in the disengaged position, as illustrated in FIG. 22.

Upon exposure to ambient pressure, frame 14 takes on an inflated condition since the pressure within frame 14 is greater than the ambient pressure. In taking on an inflated condition, frame 14 tries to pull away from chamber portion 12, thus creating a tension that provides some stiffness or rigidity to the package 10 and to chamber portion 12 (containing the modified atmosphere) relative to the state where frame 14 is not inflated. The pressure within frame 14 may be any of the pressures mentioned above with respect to the pressure within outer chamber volume 72.

Lid and base webs may be indexed forward so that cutter 76 (FIG. 5) may sever the webs to release package 10. The cutter may cut the webs, for example, by butt or die cuts as is known in the art. Although the cutter 76 is illustrated in FIG. 5 as downstream from heat closure chamber 48, the cutter may alternatively be located just upstream of the heat closure chamber 48. The packaging machine 74 may operate in an indexed and/or essentially continuous manner, to produce numerous packages 10 from the lid and base web rolls.

The manufacture of a package 11 wherein either one or both of the lid and base films are thermoformed, for example, as illustrated in FIGS. 7 and 8, may involve the use of at least one thermoforming station to thermoform a portion of the base web 40 upstream from the point where product 16 is placed on the web and/or of the lid web 38 upstream the vacuum chamber 48. Thermoforming stations and thermoforming methods are well known in the art, and include positive or negative vacuum forming and positive or negative compressed air forming, any of which may be used with or without mechanical pre-stretching and with or without plug assist. For example, the packaging machine illustrated in FIG. 5 may be modified to include a thermoforming station, such as that represented by thermoform station 80 (FIG. 24) having mold 82 and opposing plug 84, which cooperate to form base web into a desired shape, such as the shape of the thermoformed base film 136 (which in FIG. 7 includes thermoformed bottom chamber film 120 and thermoformed bottom frame film 128). Mold 82 and opposing plug 84 may shaped to form agent director 15 on frame 14 of package 10 (see, e.g., FIGS. 9-17), when webs are formed into package. Another example of a suitable thermoforming station is represented by thermoforming station 86 (FIG. 25) having forming mold 88, opposing hot plate 90, and enclosing top and lower chambers 92, 94. Mold 88 may shaped to form agent director 15 on frame 14 of package 10 (see, e.g., FIGS. 9-17) when webs are formed into package. Thermoforming station 86 may also be used to form base web into a desired shape, such as the shape of the thermoformed base film 136 (FIG. 7). Base web 40 may be formed into a series of tray shapes having flanges to facilitate the fixing of the lid web 38 to the base web 40. The bottom frame film may or may not be thermoformed. Alternatively, only the frame films, bottom and/or top frame films, may be thermoformed while the chamber films are not.

Figure 26:
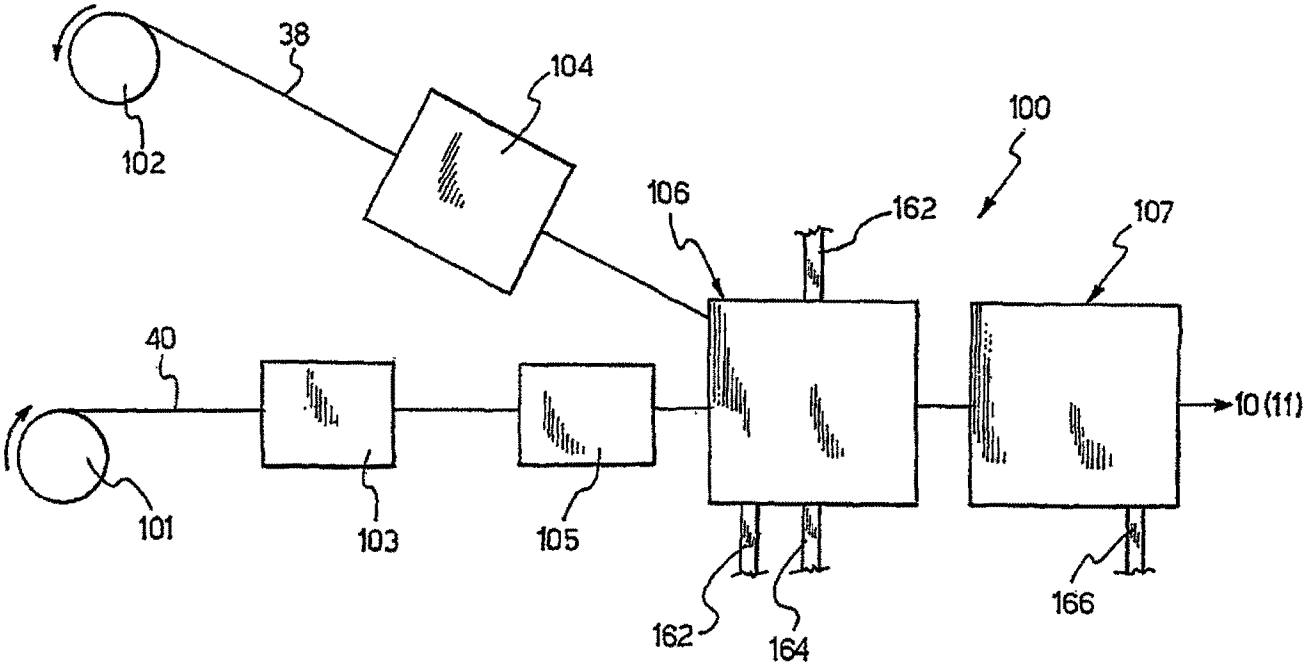
FIG. 26 is a schematic of an embodiment of a process line for making a package.

In another embodiment, package 10 (11) may be formed using the packaging machine schematically represented in FIG. 26 and indicated as 100.

In FIG. 26, 101 is unwinding station for base web roll, while 102 is unwinding station for lid web roll. 103 and 104 identify two separate thermoforming stations that can be excluded, if neither the base or the lid have to be thermoformed, or can be separately and independently actuated to provide for only base web 40, or only lid web 38 or both base and lid webs at least partially thermoformed.

When at least one of the base and lid webs is thermoformed, a profile of thermoforming may be as indicated in FIG. 27 for a base web. In FIG. 27, 136 is the overall thermoformed base film, 128 is the thermoformed bottom frame film, 109 is the outermost edge of the thermoformed bottom frame film 128, 120 is the thermoformed bottom chamber film, and 110 is the edge separating the thermoformed bottom frame film 128 from the thermoformed bottom chamber film 120. In FIGS. 27, 120, 128, and 136 correspond to the items identified with the same numerals in package 11 of FIGS. 7 and 8, and 109 and 110 correspond to the same numerals in the plan view of the thermoformed web of FIG. 28.

In station 105, product 16 may be positioned on the base web. When the base web 40 is thermoformed e.g. as in the embodiment of FIG. 27, product 16 is loaded into the thermoformed bottom chamber film.

The base web 40 loaded with product 16 and the corresponding lid web 38, are then advanced to a vacuum/gas-flushing/heat closure chamber schematically indicated by the numeral 106 ("first chamber"). The first chamber 106 differs from chamber 48 described above essentially in that it does not include an inflation gas source.

In the first chamber 106, if desired, it is possible to draw vacuum within chamber portion 12, through a vacuum source 162, and optionally introduce therein a suitably modified atmosphere 24, through a modified atmosphere source 164. Then moving the heating bars and the anvils into the engaged position, either in one single or two separate steps, all the closures of the end package 10 (11), i.e. the frame outer closure zone 32, the frangible frame inner closure zone 30 and the frangible chamber closure zone 22, are made. The thus obtained intermediate package, where product 16 is enclosed within chamber portion 12, either under vacuum or under the desired, optionally modified, atmosphere, and frame portion 14 is closed but not yet inflated, is then passed to a second severing/inflating chamber 107 ("second chamber"). In the second chamber 107, the webs are severed by suitable cutters, to separate the individual intermediate package, and then frame portion 14 is inflated by blowing the desired gas therein through a hole 108 which may be located either in the top frame film 26 (126) or in the bottom frame film 28 (128). Once frame portion 14 is inflated, hole 108 is closed or anyway separated from the inflated frame portion 14, e.g., by applying heat, before the final package leaves the second chamber 107.

Hole 108 may be created in one of the thermoforming stations 103 and 104, in the loading station 105, or in a separate dedicated station that can be positioned between the thermoforming and the product loading stations.

FIG. 28 represents a plan view of a suitably thermoformed base web entering the loading station 105. In FIG. 28, 108 is the hole that will be used to inflate frame portion 14 in severing/inflating chamber 107, and the double lines 109 and 110 are the edges of the thermoformed portions (the correspondence with the profile of FIG. 27 is indicated by using the same numerals). The web also contains slits 111, cut through the web, which are used for the optional steps of vacuumization and introduction of the modified atmosphere 24. The slits 111 may be cut through the web with the shape of a cross as illustrated in FIG. 28. The base web 40 loaded with product 16 is advanced to first chamber 106 where it is positioned so that slits 111 are immediately over matrix containing orefices which are connected through a pipe positioned below the slits, to the source of vacuum 162. Once the first vacuum chamber 106 is closed, clamping the base and lid webs inside, vacuum may be applied through the pipe and the edges of the slits 111, indicated in FIG. 28 as 111*a*, 111*b*, 111*c*, and 111*d*, are drawn down against the interior side of the pipe so as to enlarge the passage for the air. To prevent collapse of the lid web 38 over the base one 40, due to the vacuumization of the space between the two, vacuum is drawn also from the top of the vacuum chamber to keep the lid web raised over the base web 40. This can be done using a different or, as schematically illustrated in FIG. 26, the same vacuum source 162. After the drawing of vacuum, the desired modified atmosphere 24 is injected into the first chamber 106 through the same slits 111, by excluding the vacuum source 162 and actuating the modified atmosphere source 164. Once the pressure of the gas forced upwardly through the slits 111 into the vacuum chamber has reached the desired value, the heating mechanism within the chamber is arranged to close the packages individually along lines of closure zones 32 and 30, and frangible chamber closure zone 22, between the base web 40 and the lid web 38, excluding the slits 111 and leaving hole 108 within the frame portion 14. With reference to FIG. 28, the closed lines may correspond to the double lines 109 and 110.

The first chamber 106 is then opened and the webs, being fixed to one another, are advanced to the second chamber 107, where suitable cutters sever the fixed webs to release the individual package. Air or any other desired gas is then blown into the frame portion 14 through a suitable nozzle, into register with the hole 108, connected to an inflation gas and agent supply source 166. Agent may also be supplied from inflation gas and agent supply source 166. To keep hole 108 in correspondence with the nozzle, a hollow pressing device may suitably be employed. With reference to the particular embodiment illustrated in FIG. 28, where hole 108 communicates with frame portion 14 through a passage 112, this in fact should be achieved without compressing the unfixed passage 112 that needs to be free to allow inflation of frame portion 14.

Alternatively a small and flexible tube, still connected to the inflation gas and agent supply source 166, can be inserted into hole 108, and used to inflate frame portion 14. When a small tube is employed, it is also possible to connect it to a suitable pump and reservoir and inflate, and thus stiffen, frame portion 14 with any fluid, including liquids, such as water and aqueous solutions, and flowable powders. An agent may also be included in frame 14.

As soon as frame portion 14 is inflated as desired, hole 108 is closed and/or the communication between hole 108 and frame portion 14 is closed, while the package is still in severing/inflating chamber 107. This can be achieved by any means, such as for instance by applying a barrier label on top of the hole, by fixing together the top film to the bottom film of the package by applying heat in an area that includes at least the hole 108 and is larger than the hole, or by means of forming a closure around the hole by applying heat to eliminate any communication between hole 108 and frame portion 14. With reference to FIG. 28, a hole 108 may be closed either by applying heating to the passage 112 or by applying heat to the top film and the bottom film in the whole area around hole 108 which is delimited in the Figure by the double lines and by the passage 112.

In the embodiment illustrated in FIG. 6, modified atmosphere 24 is introduced into chamber 12 by the chamber inflation passageway 44, which is closed using heat or other means afterwards. The frame 14 is inflated by introducing an inflation gas or the desired fluid through frame inflation passageway 42, which is closed using heat or other means afterwards.

An end user may open package 10 (11), for example, by cutting top chamber film 18 (118) to provide access to product 16. After removal of product 16, the inflated frame 14 may be punctured to deflate it or the passageway 42, if any, may be opened. The deflated package 10 (11) may then be ready for recycling.

The new package according to the present invention may however be fitted with easy opening features that may help the end user to open the package, and particularly the chamber portion 12 without resorting to the use of cutting or puncturing tools.

Figure 31:
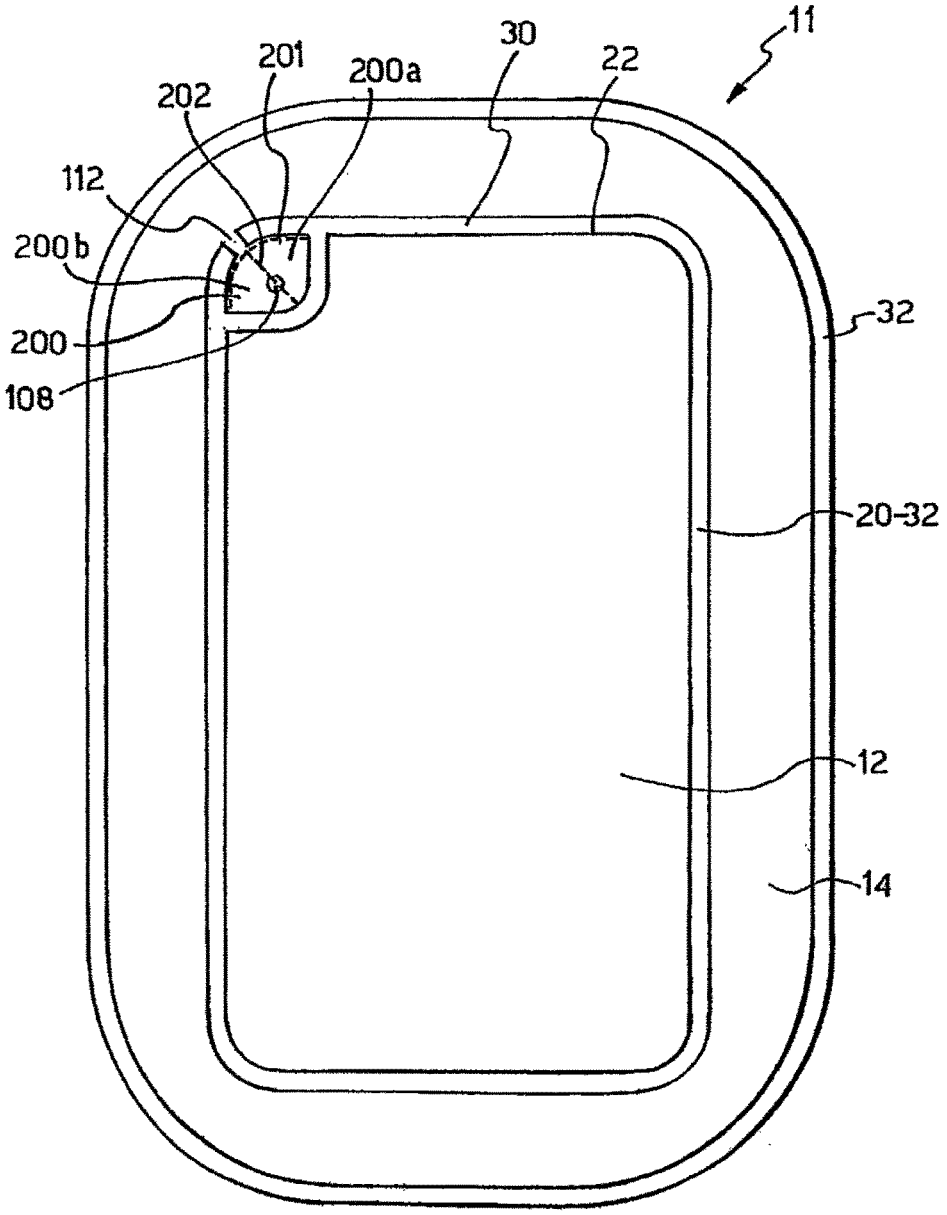

Examples of easy opening features applied to the new package are illustrated in FIGS. 29-31.

As illustrated in FIG. 29, the bottom chamber film 20 (120) or the top chamber film 18 (118) may present a weakness line 113, that may be e.g., a through cut, either continuous or discontinuous, or a line where the thickness of the film has been reduced so that a slight pressure may break the film, covered by an adhesive label 114 that has a non adhesive tab (114*a*) integral thereto so that it can be easily peeled off, when desired, by grasping the non adhesive tab with the fingers, peeling it off and thus leaving the weakness line exposed.

Alternatively, as illustrated in FIG. 30, the top chamber film 18 (118) has secured to its outer surface a tab 115 made of resilient material comprising lines of weakening 116 defining a cutter 117 capable of piercing the top chamber film 18 (118) when pressed against it. To open the package, the tab is raised, the lines of weakening 116 are bent, broken or torn by the user to expose the cutting edge of the cutter 117 which is then pressed against the top chamber film to pierce it. Also in this case the easy opening feature can alternatively be positioned on the bottom chamber film 20 (120) even if it is clearly more visible to the user if positioned on the top chamber film.

In FIG. 31 it is illustrated an embodiment of the invention where a tear-open slit, either in the form of a continuous or discontinuous cut, is created in an area of the juxtaposed lid and base films, isolated from frame portion 14 and adjacent to the frangible chamber closure zone 22, the slit being almost perpendicular to the frangible chamber closure zone 22. The package illustrated in the Figure may conveniently be obtained using the packaging machine 100 of FIG. 26 and the process illustrated above, where frame portion 14 is inflated through a hole 108 and the communication between frame portion 14 and hole 108 is then excluded by closing passage 112 by applying heat thereto or by closing together the lid and base films, by applying heat thereto, over the whole area around the hole which is delimited by the double lines and by the passage 112. The area is identified in FIG. 31 with numeral 200. Along the border of area 200 which are in contact with the frangible frame inner closure zone 30 there is a serration 201 and area 200 is divided in two parts by a second serration 202 almost perpendicular to the frangible chamber closure zone 22. By pressing on this area it is thus possible to break the serrations 201 and 202 and pulling apart the two flaps thus created, 200*a* and 200*b*, easily open chamber portion 12. Alternatively, instead of serration lines it is possible to foresee cuts through the top and bottom films.

The exemplary embodiments shown in the figures and described above illustrate but do not limit the subject matter disclosed in this specification. It should be understood that there is no intention to limit the subject matter in this specification to the specific form disclosed; rather, the disclosed subject matter is to cover all modifications and alternative constructions, as well as equivalents falling within the spirit and scope of the subject matter recited in the claims.

To the extent that the disclosure in documents that are incorporated herein by reference is inconsistent with the disclosure in the text of this document, the disclosure in the text of this document controls.

The invention claimed is:

1. A package for containing a product, the package comprising:

top and bottom opposing chamber films fixed together in a frangible chamber closure zone to define a chamber portion that is capable of containing the product; and a hollow frame adjacent to the chamber portion, wherein the hollow frame is capable of containing an agent, wherein the frangible chamber closure zone is between the chamber portion and the frame, and rupturing the frangible chamber closure zone allows the agent to flow from the frame to the chamber portion and contact the product, and wherein one film of the top and bottom chamber films includes a seal layer and a frangible layer adhered to the seal layer, the frangible layer comprises a frangible blend, the seal layer is adhered to the other film of the top and bottom chamber films within the frangible chamber closure zone.

2. The package of claim 1, wherein the frangible chamber closure zone has a release strength of 0.058 to 0.309 N/mm.

3. The package of claim 1, wherein the chamber portion contains a product and the top and bottom chamber films are collapsed together under vacuum around the product.

4. The package of claim 1, wherein the chamber portion contains a product and the chamber portion includes a modified atmosphere around the product.

5. The package of claim 1, wherein the agent includes at least one selected from the group consisting of a biocide and an organoleptic substance.

6. The package of claim 1, wherein the agent includes at least one selected from the group consisting of ozone and chlorine dioxide.

7. The package of claim 1, wherein the frame comprises top and bottom opposing frame films fixed together at a frame outer closure zone proximate an outer side of the frame, the frame further comprises a frangible frame inner closure zone proximate the chamber portion, and the frangible frame inner closure zone is coextensive with the frangible chamber closure zone.

8. The package of claim 7 wherein:

a lid film comprises both the top frame film and the top chamber film;

a base film comprises both the bottom frame film and the bottom chamber film; and the lid and base films extend continuously from the frame to the chamber portion.

9. The package of claim 8, wherein the lid film is formed from a lid web and the base film is formed from a base web.

10. The package of claim 8, wherein the lid film is fixed to the base film at the frame outer closure zone.

11. The package of claim 7, wherein the top and bottom frame films are fixed together at the frame outer closure zone by applying heat to the frame outer closure zone.

12. The package of claim 1, wherein the frame comprises a rupturable agent director formed adjacent to the frangible chamber closure zone, the rupturable agent director is configured to direct the agent toward the product upon rupturing the frangible chamber closure zone.

13. The package of claim 12, wherein the frangible chamber closure zone forms a boundary between the agent director and the chamber portion.

14. The package of claim 1, wherein the top and bottom chamber films each comprise one or more thermoplastic polymer materials.

15. A method comprising:

providing at least one agent in a hollow frame adjacent to a chamber portion of a package, wherein the package comprises:

top and bottom opposing chamber films fixed together in a frangible chamber closure zone to define the chamber portion, wherein the frangible chamber closure zone is between the chamber portion and the frame, and rupturing the frangible chamber closure zone allows the agent to flow from the frame to the chamber portion and contact a product in the chamber portion, and wherein one film of the top and bottom chamber films includes a seal layer and a frangible layer adhered to the seal layer, the frangible layer comprises a frangible blend, the seal layer is adhered to the other film of the top and bottom chamber films within the frangible chamber closure zone; and rupturing a frangible closure between the chamber portion and the hollow frame to release the at least one agent contained in the hollow frame into the chamber portion.

16. The method of claim 15, wherein the frame comprises at least two cells, a first agent is provided in a first cell of the at least two cells, a second agent is provided in a second cell of the at least two cells, and the first agent is released into the chamber portion before the second agent is released into the chamber portion.

17. A process of packaging comprising:

providing a base web comprising a material;

placing a product on the base web;

positioning over the product a lid web comprising a material;

fixing the lid web to the base web at a frangible chamber closure zone to form a chamber portion enclosing the product;

fixing the lid web to the base web at one or more frame closure zones to form a hollow frame adjacent to the chamber portion and adapted to support the chamber portion when the frame is inflated; and including an agent in the frame.

18. The process of claim 17, further comprising folding at least a portion of the base web over the product to form the lid web.

19. The process of claim 17, wherein at least one of the frame closure zones is coextensive with the frangible chamber closure zone.

20. The process of claim 17, wherein fixing the lid web to the base web at the frangible chamber closure zone forms a chamber portion enclosing a modified atmosphere within the chamber portion.

21. The process of claim 17, further comprising forming a vacuum in the chamber portion by evacuating an area configured to form the chamber portion before fixing of lid web to the base web at the frangible chamber closure zone.

22. The process of claim 17, wherein fixing the lid web to the base web at the one or more frame closure zones forms the hollow frame enclosing gas at a pressure above ambient pressure.

23. The process of claim 17, further comprising introducing a modified atmosphere into the chamber portion.

24. The process of claim 17, further comprising inflating the hollow frame.

25. The process of claim 17, further comprising thermoforming at least a portion of the base web into a desired configuration before placing the product on the base web.

26. The process of claim 17, further comprising thermoforming at least a portion of the lid web into a desired configuration before positioning the lid web over the product.

27. The process of claim 17, further comprising severing the base web to form a package base web portion and a remaining base web portion, wherein:

the hollow frame comprises the package base web portion; and the remaining base web portion is outside of the package base web portion.

28. The process of claim 17, further comprising severing the lid web to form a package lid web portion and a remaining lid web portion, wherein:

the hollow frame comprises the package lid web portion; and the remaining lid web portion is outside of the package lid web portion.

29. The process of claim 17, wherein fixing the lid web to the base web to form the chamber portion and fixing the lid web to the base web to form the frame are performed simultaneously.

* * * * *